US011556071B2

(12) United States Patent
Watanabe et al.

(10) Patent No.: US 11,556,071 B2
(45) Date of Patent: Jan. 17, 2023

(54) ELECTROSTATIC CHARGE IMAGE DEVELOPING CARRIER, ELECTROSTATIC CHARGE IMAGE DEVELOPER, PROCESS CARTRIDGE, IMAGE FORMING APPARATUS AND IMAGE FORMING METHOD

(71) Applicant: FUJIFILM Business Innovation Corp., Tokyo (JP)

(72) Inventors: Takuro Watanabe, Minamiashigara (JP); Kazutsuna Sasaki, Minamiashigara (JP); Yosuke Tsurumi, Minamiashigara (JP); Yasuo Kadokura, Minamiashigara (JP); Karin Sakai, Minamiashigara (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/397,063

(22) Filed: Aug. 9, 2021

(65) Prior Publication Data

US 2022/0308493 A1 Sep. 29, 2022

(30) Foreign Application Priority Data

Mar. 23, 2021 (JP) ..... JP2021-049112

(51) Int. Cl.
*G03G 21/16* (2006.01)
*G03G 9/113* (2006.01)
(Continued)

(52) U.S. Cl.
CPC ..... *G03G 9/1139* (2013.01); *G03G 9/0838* (2013.01); *G03G 9/1131* (2013.01); *G03G 21/1814* (2013.01)

(58) Field of Classification Search
CPC .... G03G 9/0838; G03G 9/113; G03G 9/1131; G03G 9/1139; G03G 21/1814
See application file for complete search history.

(56) References Cited

U.S. PATENT DOCUMENTS 5,705,306 A 1/1998 Kitani et al.
6,130,018 A * 10/2000 Kawata ..... G03G 9/113 399/350
(Continued)

FOREIGN PATENT DOCUMENTS

JP 7-181748 A 7/1995
JP 2007-219118 A 8/2007
(Continued)

OTHER PUBLICATIONS

Communication dated Mar. 1, 2022 by the European Patent Office in European Patent Application No. 21195634.7.

*Primary Examiner* — Hoang X Ngo
(74) *Attorney, Agent, or Firm* — Sughrue Mion, PLLC

(57) ABSTRACT

An electrostatic charge image developing carrier includes a magnetic particle and a coating resin layer that covers the magnetic particle, and an amount of the coating resin layer that is peeled off from the magnetic particle when the carrier dispersed in water is irradiated with ultrasonic waves, relative to a coating amount of the coating resin layer before ultrasonic irradiation, is 800 mass ppm or more and 2,000 mass ppm or less, and a difference between an initial coating amount of the coating resin layer of a carrier having no travel history and a coating amount of the coating resin layer of a carrier having a travel history and being taken out from an electrostatic charge image developer, relative to the initial coating amount of the coating resin layer, is 0 mass ppm or more and 3,000 mass ppm or less.

20 Claims, 2 Drawing Sheets

(51) Int. Cl.
*G03G 21/18* (2006.01)
*G03G 9/083* (2006.01)

(56) References Cited

U.S. PATENT DOCUMENTS

| | | | | |
|---|---|---|---|---|
| 2009/0109448 | A1 | 4/2009 | Kiyono et al. | |
| 2010/0135700 | A1* | 6/2010 | Mutoh | G03G 9/08 430/108.7 |
| 2011/0236813 | A1 | 9/2011 | Kiyono et al. | |
| 2013/0209932 | A1 | 8/2013 | Hasegawa et al. | |
| 2013/0252166 | A1* | 9/2013 | Yanagida | G03G 9/1133 430/124.1 |
| 2017/0227866 | A1 | 8/2017 | Sugahara et al. | |

FOREIGN PATENT DOCUMENTS

| | | | |
|---|---|---|---|
| JP | 2008-304745 | A | 12/2008 |
| JP | 5309986 | B2 | 10/2013 |
| JP | 2018-200372 | A | 12/2018 |

* cited by examiner

ELECTROSTATIC CHARGE IMAGE DEVELOPING CARRIER, ELECTROSTATIC CHARGE IMAGE DEVELOPER, PROCESS CARTRIDGE, IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2021-049112 filed on Mar. 23, 2021.

BACKGROUND

Technical Field

The present invention relates to an electrostatic charge image developing carrier, an electrostatic charge image developer, a process cartridge, an image forming apparatus, and an image forming method.

Related Art

Methods for visualizing image information such as electrophotography are currently used in various fields. In the electrophotography, an electrostatic charge image is formed as image information on a surface of an image carrier by charging and electrostatic charge image formation. Then, a toner image is formed on the surface of the image carrier by a developer containing a toner, transferred to a recording medium, and then fixed to the recording medium. Through these steps, the image information is visualized as an image.

For example, JP-A-2018-200372 discloses "an electrostatic latent image developing carrier, including: plural carrier particles each including a carrier core, and a first coat layer and second coat layer that cover a surface of the carrier core, in which the first coat layer and the second coat layer have a laminated structure in which the first coat layer and the second coat layer are laminated in this order from the surface of the carrier core, the first coat layer contains a first thermosetting resin, the second coat layer contains a second thermosetting resin, surface adsorbability of the first coat layer is 70 nN or more and 100 nN or less, and pencil hardness of the second coat layer is 2H or more and 6H or less."

JP-A-2007-219118 discloses "a two-component developer including: a toner having a volume median particle diameter of 3 μm to 8 μm, the toner being obtained by adhering inorganic fine particles to colored particles; and a carrier having a mass average particle diameter of 20 μm to 40 μm, the carrier being obtained by adhering the inorganic fine particles thereto, in which an area ratio measured by an X-ray analyzer on a carrier surface of an element (A) constituting the inorganic fine particles adhered to the toner is 0.5 area % to 3.0 area %."

JP-A-2008-304745 discloses "an electrostatic charge image developer containing a carrier having a coating resin layer on a carrier core material and a toner, in which the carrier contains 7 mass % to 35 mass % of silica or carbon black in the coating resin layer, a coating resin has a weight average molecular weight (Mw) of 300,000 to 600,000, and the toner contains external additive fine particles having a number average particle diameter of 70 nm to 300 nm."

JP-A-H07-181748 discloses "a two-component developer for developing an electrostatic latent image, including: a coat carrier obtained by applying a coating film to at least a core particle; and a toner containing at least a binder resin, a colorant, and a polarity control agent and obtained by externally adding an inorganic fine powder to particles having a volume average particle diameter of 5 μm to 10 μm, in which as shown in accompanying drawings, when a horizontal axis represents surface hardness (pencil hardness in a pencil scratch test defined by JIS K5400) of the coat carrier and a vertical axis represents a product of a square root of a specific surface area in a BET method of an external additive for the toner and an addition amount (wt %) of the external additive for the toner relative to the toner, these relations are within a range surrounded by points A, B, C, and D."

SUMMARY

Aspects of non-limiting embodiments of the present disclosure relate to providing an electrostatic charge image developing carrier including a magnetic particle and a coating resin layer that covers the magnetic particle, by which image density fluctuation over time may be prevented, as compared with a case where an amount of the coating resin layer that is peeled off from the magnetic particle when the carrier dispersed in water is irradiated with ultrasonic waves (hereinafter, also referred to as a "coating resin peeling index A") is less than 800 mass ppm or exceeds 2,000 mass ppm, or a case where a difference between an initial coating amount of the coating resin layer of a carrier having no travel history and a coating amount of the coating resin layer of a carrier having a travel history and being taken out from an electrostatic charge image developer (hereinafter, also referred to as "coating resin wear index B") is more than 3,000 mass ppm (hereinafter, also referred to as a "case where the coating resin peeling index A or the coating resin wear index B is not satisfied").

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic charge image developing carrier including:

a magnetic particle; and a coating resin layer that covers the magnetic particle, in which an amount of the coating resin layer that is peeled off from the magnetic particle when the carrier dispersed in water is irradiated with ultrasonic waves, relative to a coating amount of the coating resin layer before ultrasonic irradiation, is 800 mass ppm or more and 2,000 mass ppm or less, and a difference between an initial coating amount of the coating resin layer of a carrier having no travel history and a coating amount of the coating resin layer of a carrier having a travel history and being taken out from an electrostatic charge image developer, relative to the initial coating amount of the coating resin layer, is 0 mass ppm or more and 3,000 mass ppm or less.

BRIEF DESCRIPTION OF THE DRAWINGS

Exemplary embodiment(s) of the present invention will be described in detail based on the following figures, wherein.

DETAILED DESCRIPTION

Figure 1:
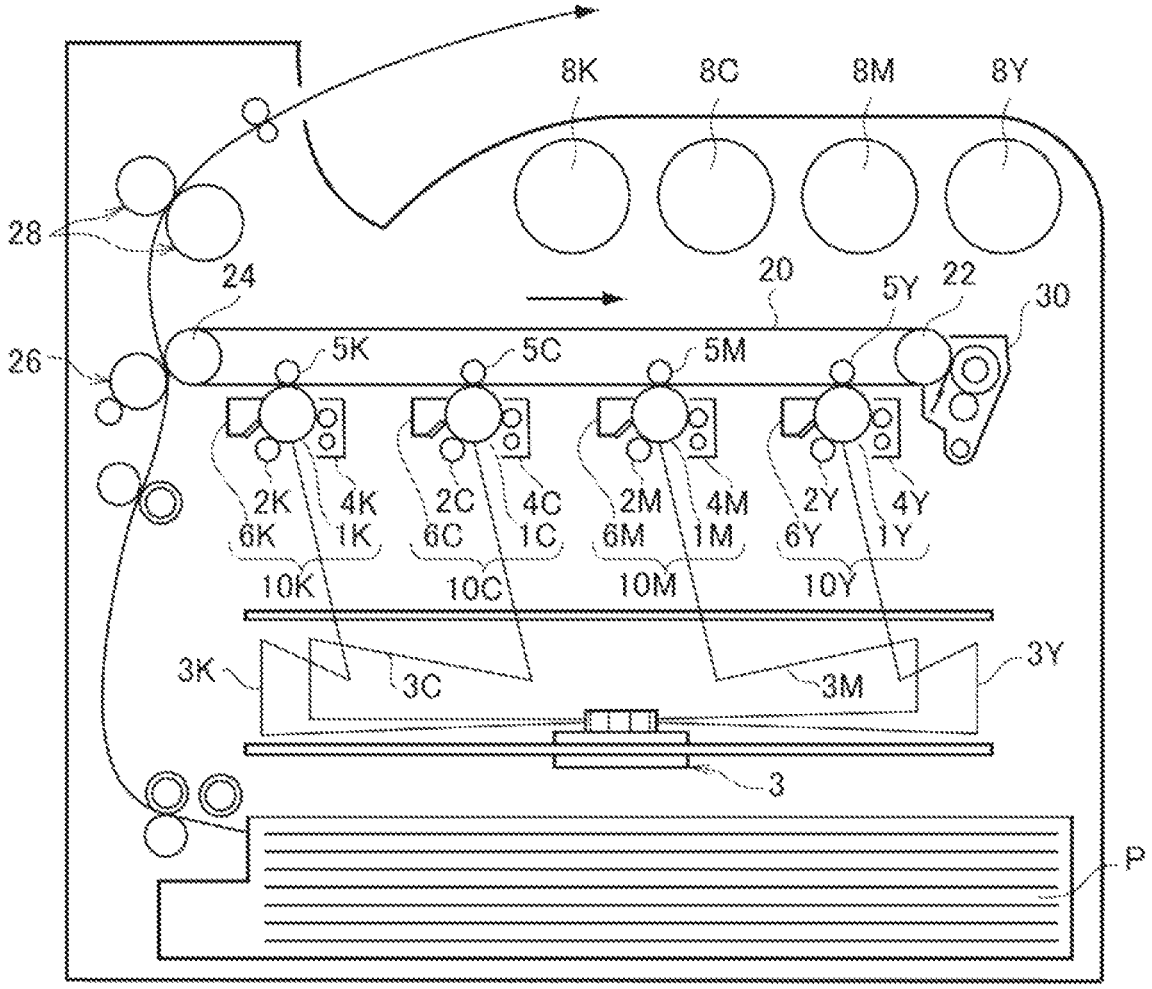
FIG. 1 is a schematic configuration diagram illustrating an example of an image forming apparatus according to the exemplary embodiment.

Hereinafter, an exemplary embodiment as an example of the present disclosure will be described. These descriptions and examples illustrate the present disclosure and do not limit the present disclosure.

In the present description, a numerical range indicated by "to" indicates a range including numerical values before and after "to" as a minimum value and a maximum value, respectively.

In the numerical ranges described in stages in the present description, an upper limit or a lower limit described in one numerical range may be replaced with an upper limit or a lower limit of the numerical range described in other stages. In the numerical ranges described in the present disclosure, the upper limit or the lower limit of the numerical range may be replaced with values shown in Examples.

In the present description, the term "step" indicates not only an independent step, and even when a step may not be clearly distinguished from other steps, this step is included in the term "step" as long as the intended purpose of the step is achieved.

In an exemplary embodiment described in the present description with reference to drawings, a configuration of the exemplary embodiment is not limited to a configuration illustrated in the drawings. Sizes of members in each drawing are conceptual, and a relative size relation between the members is not limited to this.

In the present description, each component may include plural corresponding substances. In the present disclosure, in a case of referring to an amount of each component in a composition, when there are plural substances corresponding to each component in the composition, unless otherwise specified, it refers to a total amount of the plural substances included in the composition.

In the present description, each component may include plural corresponding particles. When there are plural kinds of particles corresponding to each component in a composition, unless otherwise specified, a particle diameter of each component means a value for a mixture of the plural kinds of particles included in the composition.

In the present description, the term "(meth)acryl" means at least one of acryl and methacryl, and the term "(meth) acrylate" means at least one of acrylate and methacrylate.

In the present description, the term "electrostatic charge image developing toner" may be simply referred to as a "toner", the term "electrostatic charge image developing carrier" may be simply referred to as a "carrier", and the term "electrostatic charge image developer" may be simply referred to as a "developer".

<Electrostatic Charge Image Developing Carrier>

A carrier according to the exemplary embodiment includes a magnetic particle and a coating resin layer that covers the magnetic particle.

In the carrier according to the exemplary embodiment, an amount of the coating resin layer that is peeled off from the magnetic particle when the carrier dispersed in water is irradiated with ultrasonic waves relative to a coating amount of the coating resin layer before ultrasonic irradiation (i.e. coating resin peeling index A) is 800 mass ppm or more and 2,000 mass ppm or less, and a difference between an initial coating amount of the coating resin layer of a carrier having no travel history and a coating amount of the coating resin layer of a carrier having a travel history and being taken out from an electrostatic charge image developer relative to the initial coating amount of the coating resin layer (i.e. coating resin wear index B) is 0 mass ppm or more and 3,000 mass ppm or less.

The carrier according to the exemplary embodiment prevents image density fluctuation over time based on the above configuration. The reasons are presumed as follows.

In a developer containing a toner and a carrier, image density fluctuation occurs due to charge fluctuation relative to an initial charge over time. As a factor of the charge fluctuation, there is a change in structures of both the toner and the carrier with the elapsed time.

From the standpoint of the toner, 1) an external additive is embedded in toner particles by a mechanical load due to stirring of a developing unit, or an amount of a released (free) external additive is reduced due to migration of the external additive to the carrier, and 2) the toner particles are exposed, so that a difference between the initial charge and the charge after the elapse of time occurs.

On the other hand, from the standpoint of the carrier, 1) the released external additive from the toner adheres to the carrier, and 2) the coating resin layer that applies charge wears due to the mechanical load due to stirring of the developing unit, so that the difference between the initial charge and the charge after the elapse of time occurs.

Therefore, in the carrier in the related art, it is common that a wear amount of the coating resin layer is reduced by using a thermosetting resin or crosslinked resin as a resin of the coating resin layer.

However, in a case where an image having a high image density of 40% or more is continuously printed at a high speed for a long period of time, the charge fluctuation due to adhesion of the released external additive from the toner to the carrier may not be prevented. Further, in a case where an image having a low image density of 0.5% or less is continuously printed at a high speed for a long period of time, the external additive is embedded in the toner particles, or the external additive migrates to the carrier, so that the amount of the released external additive that move between the toner and the carrier is reduced, the toner particles are exposed, and the charge fluctuation may not be prevented.

In contrast, in the carrier according to the exemplary embodiment, the coating resin peeling index A and the coating resin wear index B are within the above ranges.

The coating resin peeling index A indicates a peelability of the coating resin layer by ultrasonic waves (that is, adhesiveness between the magnetic particle and the coating resin layer). Then, the coating resin peeling index A satisfying the above range means that the peelability of the coating resin layer by the ultrasonic waves is high, that is, the coating resin layer is easily peeled off.

The coating resin wear index B indicates wear resistance of the coating resin layer (that is, scraping resistance of the coating resin layer). Then, the coating resin wear index B satisfying the above range means that the coating resin layer has high wear resistance, that is, the coating resin layer is less likely to be worn.

The fact that the peelability of the coating resin layer by the ultrasonic waves is high means that the carrier has a structure in which there are many regions where the coating resin layer is in point-contact with the magnetic particle, an anchoring effect (that is, anchor effect) is small, and a gap exists between a surface of the magnetic particle and the coating resin layer.

Therefore, in addition to increasing the wear resistance of the coating resin layer and preventing the wear of the coating resin layer as in the related art, the peelability of the coating resin layer by the ultrasonic wave is increased and a gap is allowed to exist between the surface of the magnetic particle and the coating resin layer, and then the gap absorbs impact when the carrier collides with the toner.

Accordingly, the external additive being embedded in the toner particles and exposure of the toner particles that occur when the carrier and the toner collide with each other may be prevented. Movement of the external additive from the toner to the carrier is also prevented, and prevention of the decrease in amount the released (free) external additive is also realized. As a result, the charge fluctuation of the toner over time is prevented, and the image density fluctuation over time is prevented.

From the above, it is presumed that the carrier according to the exemplary embodiment prevents the image density fluctuation over time.

In the coating resin layer containing a thermoplastic resin in the related art, the peelability of the coating resin layer by the ultrasonic waves is low, and the wear resistance of the coating resin layer is low. Further, in the coating resin layer containing a thermosetting resin or crosslinked resin in the related art, the peelability of the coating resin layer by the ultrasonic waves is low, and the wear resistance of the coating resin layer is high.

Hereinafter, the carrier according to the exemplary embodiment will be described in detail.

(Coating Resin Peeling Index A and Coating Resin Wear Index B)

In the carrier according to the exemplary embodiment, the coating resin peeling index A relative to the coating amount of the coating resin layer before ultrasonic irradiation is 800 mass ppm or more and 2,000 mass ppm or less, and is preferably 1,000 mass ppm or more and 1,800 mass ppm or less, and more preferably 1,200 mass ppm or more and 1600 mass ppm or less from the viewpoint of preventing the image density fluctuation over time.

The coating resin peeling index A is a ratio of the coating resin layer that is peeled off from the magnetic particle when the carrier dispersed in water is irradiated with ultrasonic waves. Specifically, the coating resin peeling index A is measured as follows.

40 g of the carrier accurately measured to the degree of mg unit is put in a 100 ml beaker. Next, 40 ml of 0.1% nonionic surfactant (HS-208, manufactured by NOF Corporation) aqueous solution is added and the mixture is heated to 38° C. The mixture is irradiated by an ultrasonic homogenizer (US-300TCVP-3, manufactured by NISSEI Corporation) for 4 minutes at a Level V (200 μA). Thereafter, a magnet is placed on the bottom of the beaker, and the liquid is transferred to a different beaker. At this time, the operation is adjusted such that the carrier does not move to the different beaker.

(1) 40 ml of the nonionic surfactant aqueous solution is further added to the beaker containing the carrier and the mixture is stirred with a glass rod for 3 minutes, and then the liquid is transferred to the different beaker again.

Subsequently, the operation (1) is repeated three times.

A filter paper is accurately measured to the degree of mg unit, and this is taken as X mg. This filter paper is used to filter the 0.1% nonionic surfactant aqueous solution transferred to the different beaker, and impurities in the nonionic surfactant aqueous solution are separated by the filtration. The filter paper is put in a dryer (50° C.) and allowed to stand for 12 hours. After 12 hours, the filter paper is taken out from the dryer and cooled to 25° C., and a weight of the filter paper is accurately measured to the degree of mg unit. This is taken as Y mg.

An amount of the coating resin layer peeled is measured by the following equation.

$$\text{Amount of coating resin layer peeled (ppm)} = (Y-X)/(\text{carrier weight})$$

In the carrier according to the exemplary embodiment, the coating resin wear index B relative to the initial coating amount of the coating resin layer of the carrier having no travel history is 0 mass ppm or more and 3,000 mass ppm or less, and is preferably 0 mass ppm or more and 2,000 mass ppm or less, and more preferably 0 mass ppm or more and 1,000 mass ppm or less from the viewpoint of preventing the image density fluctuation over time.

The coating resin wear index B is a difference between the initial coating amount of the coating resin layer of a carrier having no travel history and the coating amount of the coating resin layer of a carrier having a travel history and being taken out from the electrostatic charge image developer (corresponding to "wear amount"="initial coating amount of the coating resin layer of a carrier having no travel history"– "coating amount of the coating resin layer of a carrier having a travel history and being taken out from the electrostatic charge image developer"). Specifically, measurement is performed as follows.

The carrier for confirming the wear amount is a carrier obtained by separating the toner by blow-off from 7.5 g of the electrostatic charge image developer having a travel history and being collected from the image forming apparatus, and the carrier for confirming the initial coating amount is a carrier obtained by separating the toner by blow-off from a replenishing cartridge or a non-traveling initial developer of the image forming apparatus. As long as the carrier is separated from the toner, any method other than the blow-off may be adopted.

Here, the electrostatic charge image developer having a travel history is an electrostatic charge image developer obtained by adding a developer prepared by mixing the carrier and the toner at a mass ratio of 100:8 into a developing device at a M color position in the image forming apparatus ("Docucenter VII C37773" manufactured by Fuji Xerox Co., Ltd.) and printing an image having an image density equivalent to 1% on each of 10,000 sheets with A4 paper size by the image forming apparatus. The toner of the developer is a magenta toner for "Docucenter VII C37773" manufactured by Fuji Xerox Co., Ltd.

For each, the coating amount of the coating resin layer is determined as follows.

In a case of a solvent-soluble coating resin layer, the carrier accurately weighed is dissolved in a solvent (for example, toluene, N-methylpyrrolidone, or the like) that may dissolve the coating resin layer, the magnetic particles are held by the magnet, and the solution in which the coating resin layer is dissolved is washed away. By repeating this operation several times, the magnetic particles from which the coating resin layer is removed remain. The magnetic particles are dried, and the mass of the magnetic particles are measured, and then the coating amount is calculated by dividing the difference by a carrier amount.

Specifically, 2.0 g of the carrier is weighed and put into the beaker, 30 cc of toluene is added thereto and the mixture is stirred by a stirring blade for 15 minutes. The magnet is placed on the bottom of the beaker, and the toluene is allowed to flow such that the magnetic particles do not flow out. This operation is repeated four times, and the beaker after washing away is dried. The amount of the magnetic particles after drying is measured, and the coating amount (mass ppm) is calculated from the equation "(carrier amount−amount of magnetic particles after washing)/carrier amount".

On the other hand, in a case of a solvent-insoluble coating resin layer, the coating resin layer is heated at a temperature range from room temperature (25° C.) to 1,000° C. in a nitrogen atmosphere using a Thermo plus EVOII differential type differential thermal balance TG820 manufactured by Rigaku Corporation, and the resin coating amount is calculated from the mass decrease.

In the carrier according to the exemplary embodiment, in order to satisfy the coating resin peeling index A and the coating resin wear index B, the carrier may have the aspects described below.

(Configuration of Carrier)

A carrier according to the exemplary embodiment includes a magnetic particle and a coating resin layer that covers the magnetic particle.

<<Magnetic Particle>>

The magnetic particle is not particularly limited, and common magnetic particles used as a core material of the carrier may be used. Specific examples of the magnetic particle include: particles of a magnetic metal such as iron, nickel, or cobalt; particles of a magnetic oxide such as ferrite or magnetite; resin-impregnated magnetic particles obtained by impregnating a porous magnetic powder with a resin; and magnetic powder-dispersed resin particles in which a magnetic powder is dispersed and blended in a resin. The ferrite particle may be used as the magnetic particle in the exemplary embodiment.

A volume average particle diameter of the magnetic particles may be 15 μm or more and 100 μm or less, and is preferably 20 μm or more and 80 μm or less, and still more preferably 30 μm or more and 60 μm or less.

The volume average particle diameter of the magnetic particle is measured by the following method.

A particle size distribution is measured using a laser diffraction/scattering particle size distribution measuring device (LS Particle Size Analyzer (manufactured by Beckman Coulter, Inc.)). As an electrolytic solution, ISOTON-II (manufactured by Beckman Coulter, Inc.) is used. The number of particles to be measured is 50,000.

Then, as for the measured particle size distribution, a cumulative distribution of a volume is drawn from a small diameter side with respect to a divided particle size range (channel), and a particle diameter (D50v) at 50% accumulation is defined as the "volume average particle diameter".

The arithmetic average height Ra (JIS B0601:2001) of the roughness curve of the magnetic particles is obtained by observing the magnetic particles at an appropriate magnification (for example, a magnification of 1000 times) using a surface profile measuring device (for example, "Ultra Depth Color 3D profile measurement microscope VK-9700" manufactured by KEYENCE CORPORATION), obtaining a roughness curve at a cutoff value of 0.08 mm, and extracting a reference length of 10 μm from the roughness curve in a direction of an average line thereof. The arithmetic average value of Ra of 100 magnetic particles may be 0.1 μm or more and 1.0 μm or less, and is preferably 0.2 μm or more and 0.8 μm or less.

As for a magnetic force of the magnetic particles, saturation magnetization in a magnetic field of 3,000 Oersted may be 50 emu/g or more, and is preferably 60 emu/g or more. The saturation magnetization is measured using a vibration sample type magnetic measuring device VSMP10-15 (manufactured by Toei Industry Co., Ltd.). A measurement sample is packed in a cell having an inner diameter of 7 mm and a height of 5 mm and set in the device. The measurement is performed by applying a magnetic field and sweeping up to 3000 Oersted. Next, the applied magnetic field is reduced to create a hysteresis curve on a recording sheet. Saturation magnetization, residual magnetization, and a holding force are obtained from data of the curve.

A volume electric resistance (volume resistivity) of the magnetic particles may be $1\times10^5$ Ω·cm or more and $1\times10^9$ Ω·cm or less, and is preferably $1\times10^7$ Ω·cm or more and $1\times10^9$ Ω·cm or less.

The volume electric resistance (Ω·cm) of the magnetic particles is measured as follows. A layer is formed by flatly placing an object to be measured on a surface of a circular jig on which a 20 $cm^2$ electrode plate is arranged so as to have a thickness of 1 mm or more and 3 mm or less. Another 20 $cm^2$ electrode plate is placed thereon to sandwich the layer therebetween. The thickness (cm) of the layer is measured after a load of 4 kg is applied to the electrode plate arranged on the layer to eliminate voids between the object to be measured and the electrode plates. Both electrodes above and below the layer are connected to an electrometer and a high voltage power generator, respectively. A high voltage is applied to both electrodes such that an electric field is 103.8 V/cm, and a current value (A) flowing at this time is read. A measurement environment is under a temperature of 20° C. and a relative humidity of 50%. An equation for calculating the volume electric resistance (Ω·cm) of the object to be measured is as shown in the following equation.

$$R=E\times20/(I-I_0)/L$$

In the above equation, R represents the volume electric resistance (Ω·cm) of the object to be measured, E represents the applied voltage (V), I represents the current value (A), $I_0$ represents a current value (A) at an applied voltage of 0 V, and L represents the thickness (cm) of the layer. The coefficient 20 represents the area ($cm^2$) of the electrode plate.

<<Coating Resin Layer>>

The coating resin layer contains a resin. The coating resin layer satisfies the coating resin peeling index A and the coating resin wear index B, and may contain an inorganic particle from the viewpoint of preventing the image density fluctuation over time.

—Resin—

Examples of the resin contained in the coating resin layer include styrene-acrylic resin; polyolefin-based resins such as polyethylene and polypropylene; polyvinyl-based or polyvinylidene-based resins such as polystyrene, an acrylic resin, polyacrylonitrile, polyvinyl acetate, polyvinyl alcohol, polyvinyl butyral, polyvinyl chloride, polyvinylcarbazole, polyvinyl ether, and polyvinylketone; a vinyl chloride-vinyl acetate copolymer; straight silicone resins including an organosiloxane bond or a modified product thereof; fluororesins such as polytetrafluoroethylene, polyvinyl fluoride, polyvinylidene fluoride, and polychlorotrifluoroethylene; polyester; polyurethane; polycarbonate; amino resins such as urea and formaldehyde resins; and epoxy resins.

The coating resin layer may contain an acrylic resin having an alicyclic structure. A polymerization component of the acrylic resin having an alicyclic structure may be a lower alkyl ester of (meth)acrylic acid (for example, (meth) acrylic acid alkyl ester having an alkyl group having 1 to 9 carbon atoms), and specific examples thereof include methyl (meth)acrylate, ethyl (meth)acrylate, propyl (meth)acrylate, butyl (meth)acrylate, hexyl (meth)acrylate, cyclohexyl (meth)acrylate, and 2-ethylhexyl (meth)acrylate. These monomers may be used alone or in combination of two or more kinds thereof.

The acrylic resin having an alicyclic structure may contain cyclohexyl (meth)acrylate as the polymerization component. A content of a monomer unit derived from the cyclohexyl (meth)acrylate contained in the acrylic resin having an alicyclic structure may be 75 mass % or more and 100 mass % or less, and is preferably 85 mass % or more and 100 mass % or less, and more preferably 95 mass % or more and 100 mass % or less, relative to a total mass of the acrylic resin having an alicyclic structure.

The weight average molecular weight of the resin contained in the coating resin layer may be less than 300,000, and is preferably less than 250,000, and more preferably less than 200,000.

In the case where the weight average molecular weight of the resin contained in the coating resin layer is reduced to fall within the above range, a coating resin viscosity is within an optimal range, and a binding force between the coating resins, a binding force between the resin and the inorganic particle and the uptake property, and a binding force between the resin and a core are within an optimal range. Therefore, the image density fluctuation over time is further prevented.

Here, in terms of the lower limit of the weight average molecular weight of the resin contained in the coating resin layer, the weight average molecular weight may be 20,000 or more, and is preferably 50,000 or more from the viewpoint of preventing the coating resin viscosity from being too low to lower the binding force, and preventing the coating resin peeling index A or coating resin wear index B from being not satisfied.

Here, the weight average molecular weight is measured by gel permeation chromatography (GPC). Molecular weight measurement by GPC is performed by using a measurement device GPC·HLC-8120 manufactured by Tosoh Corporation, a column TSKgel SuperHM-M (15 cm) manufactured by Tosoh Corporation, and a THF solvent. The weight average molecular weight is determined from the measurement result using a molecular weight calibration curve prepared using a monodispersed polystyrene standard sample.

—Inorganic Particle—

Examples of the inorganic particle contained in the coating resin layer include metal oxide particles such as silica, titanium oxide, zinc oxide, and tin oxide; metal compound particles such as barium sulfate, aluminum borate, and potassium titanate; and particles of metal such as gold, silver, or copper. In the exemplary embodiment, carbon black is not the inorganic particle.

Among these, from the viewpoint of preventing the image density fluctuation over time, the inorganic particle is preferably an inorganic oxide particle, and more preferably a silica particle.

Particularly, the inorganic particle may have the same charge polarity as the external additive (particularly, silica particles) for the toner during triboelectric charging with the carrier. In the case where the inorganic particle has the same charge polarity as the external additive for the toner, electrostatic repulsion of the inorganic particle exposed from the coating resin layer acts to reduce the adhesive force of the carrier to the external additive. As a result, the image density fluctuation over time is further prevented.

Specifically, the inorganic particle may have the same charge polarity (negative polarity) as the silica particle as the external additive for the toner.

The charge polarity of the particles is measured by a blow-off method. Since a particle diameter of each particle is small relative to the carrier, a mixing ratio of the particles is decreased in order to reduce a proportion of the particles that may not be brought into contact with the carrier. For example, the polarity may be determined by mixing 9.9 g of the carrier and 0.1 g of the particles and subjecting the mixture to the blow-off method.

Surfaces of the inorganic particles may be subjected to a hydrophobic treatment. Examples of a hydrophobic treatment agent include common organic silicon compounds having an alkyl group (for example, a methyl group, an ethyl group, a propyl group, a butyl group, or the like), and specific examples thereof include an alkoxysilane compound, a siloxane compound, and a silazane compound. Among these, the hydrophobic treatment agent is preferably a silazane compound, and preferably hexamethyldisilazane. The hydrophobic treatment agent may be used alone or in combination of two or more kinds thereof.

Examples of a method for hydrophobizing the inorganic particles with the hydrophobic treatment agent include a method in which supercritical carbon dioxide is used and the hydrophobic treatment agent is dissolved in the supercritical carbon dioxide to be attached to the surfaces of the inorganic particles, a method in which a solution containing a hydrophobic treatment agent and a solvent for dissolving the hydrophobic treatment agent is applied (for example, by spraying or coating) to the surfaces of the inorganic particles in the atmosphere to attach the hydrophobic treatment agent to the surfaces of the inorganic particles, and a method in which a solution containing a hydrophobic treatment agent and a solvent for dissolving the hydrophobic treatment agent is added to and held in an inorganic particle dispersion liquid in the air, and then a mixed solution of the above solution and the inorganic particle dispersion liquid is dried.

A content of the inorganic particle contained in the coating resin layer may be 20 mass % or more and 60 mass % or less, and is preferably 20 mass % or more and 50 mass % or less, more preferably 25 mass % or more and 50 mass % or less, and further preferably 25 mass % or more and 40 mass % or less, relative to a total mass of the coating resin layer.

In the case where a large amount of inorganic particles are contained in the coating resin layer within the above range, fine unevenness due to the inorganic particles is made in the surface of the coating resin layer, the wear resistance is improved, and the adhesive force of the carrier to the external additive is reduced. Further, a gap between the magnetic particle and the coating resin layer is easily formed, and an impact relaxation action by the coating resin layer is easily obtained. As a result, the image density fluctuation over time is further prevented.

The coating resin layer may contain a conductive particle for a purpose of controlling charging or resistance. Examples of the conductive particles include carbon black and conductive particles that has conductivity and are described above as the inorganic particle.

—Forming Method of Coating Resin Layer—

Examples of a method for forming the coating resin layer on the surface of the magnetic particles include a wet production method and a dry production method. The wet production method is a production method using a solvent that dissolves or disperses the resin constituting the coating resin layer. On the other hand, the dry production method is a production method that does not use the above solvent.

Examples of the wet production method include an immersion method in which the magnetic particles are immersed in a resin liquid for forming the coating resin layer to perform coating, a spray method in which a resin liquid for forming the coating resin layer is sprayed on the surfaces of the magnetic particles, a fluidized bed method in which a resin liquid for forming the coating resin layer is sprayed while fluidizing the magnetic particles in a fluidized bed, and a kneader coater method in which the magnetic particles and a resin liquid for forming the coating resin layer are mixed in a kneader coater to remove a solvent. These production methods may be repeated or combined.

The resin liquid for forming the coating resin layer used in the wet production method is prepared by dissolving or dispersing a resin, inorganic particles, and other components in a solvent. The solvent is not particularly limited, and for example, aromatic hydrocarbons such as toluene and xylene, ketones such as acetone and methyl ethyl ketone, ethers such as tetrahydrofuran and dioxane, or the like may be used.

Examples of the dry production method include a method of forming the coating resin layer by heating a mixture of the magnetic particles and a resin for forming the coating resin layer in a dry state. Specifically, for example, the magnetic particles and the resin for forming the coating resin layer are mixed in a gas phase and heated and melted to form the coating resin layer.

(Average Particle Diameter of Inorganic Particles/Average Thickness of Coating Resin Layer)

In the carrier according to the exemplary embodiment, the average particle diameter of the inorganic particle may be smaller than the average thickness of the coating resin layer.

Specifically, the ratio of the average particle diameter of the inorganic particle to the average thickness of the coating resin layer (average particle diameter of inorganic particle/average thickness of coating resin layer) may be 0.005 or more and 0.1500 or less, and is preferably 0.007 or more and 0.12 or less.

In the case where the average particle diameter of the inorganic particle is smaller than the average thickness of the coating resin layer and the inorganic particle is dispersed in the coating resin layer and exposed from the coating resin layer, the external additive is hardly transferred to the carrier. As a result, the image density fluctuation over time is further prevented.

The average particle diameter of the inorganic particle may be 5 nm or more and 90 nm or less, and is preferably 5 nm or more and 70 nm or less, more preferably 5 nm or more and 50 nm or less, and further more preferably 8 nm or more and 50 nm or less, from the viewpoint of preventing the image density fluctuation over time.

The average particle diameter of the inorganic particle contained in the coating resin layer may be controlled by a size of the inorganic particle used for forming the coating resin layer.

The average thickness of the coating resin layer may be 0.6 μm or more and 1.4 μm or less, and is preferably 0.8 μm or more and 1.2 μm or less, and still more preferably 0.8 μm or more and 1.1 μm or less, from the viewpoint of preventing the image density fluctuation over time.

The average thickness of the coating resin layer may be controlled by an amount of the resin used for forming the coating resin layer, and the average thickness of the coating resin layer increases as the amount of the resin relative to the amount of the magnetic particle increases.

Here, the average particle diameter of the inorganic particle contained in the coating resin layer and the average thickness of the coating resin layer are measured by the following method.

The carrier is embedded in an epoxy resin and cut with the microtome, and the sample having the carrier cross section as the observation surface is prepared. As for the carrier cross section, the SEM image (magnification: 20,000 times) obtained by capturing the cross section of the coating resin layer with the scanning electron microscope (SEM) is taken into the image processing analyzer for image analysis. 100 inorganic particles (primary particles) in the coating resin layer are randomly selected, and an equivalent circular diameter (nm) of each particle is determined and arithmetically averaged to obtain the average particle diameter (nm) of the inorganic particle. The thickness (μm) of the coating resin layer is measured as follows: 10 points per particle of the carrier are randomly selected, and 100 particles of the carrier are further selected to measure thicknesses thereof, and all the thicknesses are arithmetically averaged to obtain the average thickness (μm) of the coating resin layer.

(Characteristics of Carrier)

—Arithmetic Average Height Ra of Roughness Curve—

The arithmetic average height Ra (JIS B0601:2001) of the roughness curve of the carrier according to the exemplary embodiment may be 0.1 μm or more and 1.0 μm or less, and is preferably 0.2 μm or more and 0.8 μm or less.

In the case where the arithmetic average height Ra of the roughness curve of the carrier falls within the above range, the external additive is hardly transferred to the carrier. As a result, the image density fluctuation over time is further prevented.

The arithmetic average height Ra of the roughness curve of the carrier is determined by observing the magnetic particle at an appropriate magnification (for example, a magnification of 1,000 times) using a surface profile measuring device (for example, "Ultra Depth Color 3D profile measurement microscope VK-9700" manufactured by Keyence Corporation), obtaining a roughness curve at a cutoff value of 0.08 mm, and extracting a reference length of 10 μm in a direction of an average line thereof from the roughness curve. The data obtained from 100 carriers is arithmetically averaged to determine the arithmetic average height Ra.

—Exposed Area Ratio of Magnetic Particle—

An exposed area ratio of the magnetic particle on a carrier surface according to the exemplary embodiment may be 5% or more and 30% or less, and is preferably 7% or more and 25% or less, and more preferably 10% or more and 25% or less. The exposed area ratio of the magnetic particles in the carrier may be controlled by the amount of the resin used for forming the coating resin layer, and the exposed area ratio becomes smaller as the amount of the resin relative to the amount of the magnetic particle increases.

The exposed area ratio of the magnetic particle on the carrier surface is a value obtained by the following method.

A target carrier and the magnetic particle obtained by removing the coating resin layer from the target carrier are prepared. Examples of a method for removing the coating resin layer from the carrier include a method of dissolving a resin component in an organic solvent to remove the coating resin layer, a method of removing the resin component by heating at about 800° C. to remove the coating resin layer, and the like. The carrier and the magnetic particle are used as measurement samples, and Fe concentrations (atomic %) on surfaces of the samples are quantified by XPS, and "(Fe concentration of the carrier)/(Fe concentration of the magnetic particles)×100" is calculated, and the calculated value is defined as the exposed area ratio (%) of the magnetic particle.

A volume average particle diameter of the carrier according to the exemplary embodiment may be 10 μm or more and 120 μm or less, and is preferably 20 μm or more and 100 μm or less, and more preferably 30 μm or more and 80 μm or less.

The volume average particle diameter of the carrier means the particle diameter $D50_V$ at 50% accumulation from the small diameter side in a particle size distribution based on volume, and is measured by the same method as the volume average particle diameter of the magnetic particle.

<Electrostatic Charge Image Developer>

The developer according to the exemplary embodiment is a two-component developer containing the carrier according to the exemplary embodiment and a toner. The toner contains a toner particle and, if necessary, an external additive.

A mixing ratio (mass ratio) of the carrier and the toner in the developer may be carrier:toner=100:1 to 100:30, and is preferably 100:3 to 100:20.

<<Toner Particles>>

The toner particle contains, for example, a binder resin, and if necessary, a colorant, a releasing agent, and other additive(s).

—Binder Resin—

Examples of the binder resin include vinyl-based resins made of a homopolymer of monomers such as styrenes (such as styrene, parachlorostyrene, and α-methylstyrene), (meth)acrylic acid esters (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene), and a copolymer obtained by combining two or more kinds of these monomers.

Examples of the binder resin include non-vinyl-based resins such as an epoxy resin, a polyester resin, a polyurethane resin, a polyamide resin, a cellulose resin, a polyether resin, and a modified resin, a mixture of the non-vinyl-based resin and the vinyl-based resin, and a graft polymer obtained by polymerizing a vinyl-based monomer in the presence of the non-vinyl-based resin.

The binder resin may be used alone or in combination of two or more kinds thereof.

The binder resin is suitably a polyester resin.

Examples of the polyester resin include common amorphous polyester resins. As the polyester resin, a crystalline polyester resin may be used in combination with the amorphous polyester resin. However, the crystalline polyester resin may be used in an amount of 2 mass % or more and 40 mass % or less (preferably 2 mass % or more and 20 mass % or less) relative to a total amount of the binder resin.

"Crystalline" of a resin refers to one having a clear endothermic peak rather than a stepwise endothermic change in differential scanning calorimetry (DSC), and specifically means one having a half width of the endothermic peak when measured at a heating rate of 10 (° C./min) being within 10° C.

On the other hand, "amorphous" of a resin means one having a half width of higher than 10° C., showing a stepwise endothermic change, or not showing a clear endothermic peak.

Amorphous Polyester Resin

Examples of the amorphous polyester resin include a condensed polymer of a polycarboxylic acid and a polyhydric alcohol. As the amorphous polyester resin, a commercially available product may be used, or a synthetic resin may be used.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (such as cyclohexanedicarboxylic acid), aromatic dicarboxylic acids (such as terephthalic acid, isophthalic acid, phthalic acid, and naphthalenedicarboxylic acid), anhydrides thereof, and lower alkyl esters thereof (e.g., having 1 to 5 carbon atoms). Among these, the polycarboxylic acid is preferably, for example, an aromatic dicarboxylic acid.

As for the polycarboxylic acid, a trivalent or higher carboxylic acid having a crosslinked structure or a branched structure may be used in combination with the dicarboxylic acid. Examples of the trivalent or higher carboxylic acid include trimellitic acid, pyromellitic acid, anhydride thereof, and lower alkyl esters thereof (e.g., having 1 to 5 carbon atoms).

The polycarboxylic acid may be used alone or in combination of two or more kinds thereof.

Examples of the polyhydric alcohol include aliphatic diols (such as ethylene glycol, diethylene glycol, triethylene glycol, propylene glycol, butanediol, hexanediol, and neopentyl glycol), alicyclic diols (such as cyclohexanediol, cyclohexanedimethanol, and hydrogenated bisphenol A), and aromatic diols (such as an ethylene oxide adduct of bisphenol A and a propylene oxide adduct of bisphenol A). Among these, the polyhydric alcohol is preferably, for example, an aromatic diol or an alicyclic diol, and more preferably an aromatic diol.

As for the polyhydric alcohol, a trihydric or higher polyhydric alcohol having a crosslinked structure or a branched structure may be used in combination with the diol. Examples of the trihydric or higher polyhydric alcohol include glycerin, trimethylolpropane, and pentaerythritol.

The polyhydric alcohol may be used alone or in combination of two or more kinds thereof.

A glass transition temperature (Tg) of the amorphous polyester resin may be 50° C. or higher and 80° C. or lower, and is preferably 50° C. or higher and 65° C. or lower.

The glass transition temperature is obtained from a DSC curve obtained by the differential scanning calorimetry (DSC), and is more specifically obtained by the "extrapolated glass transition onset temperature" described in the method for obtaining the glass transition temperature in "Method for measuring glass transition temperature of plastics" in JIS K 7121:1987.

A weight average molecular weight (Mw) of the amorphous polyester resin may be 5,000 or more and 1,000,000 or less, and is preferably 7,000 or more and 500,000 or less.

A number average molecular weight (Mn) of the amorphous polyester resin may be 2,000 or more and 100,000 or less.

A molecular weight distribution Mw/Mn of the amorphous polyester resin may be 1.5 or more and 100 or less, and is preferably 2 or more and 60 or less.

The weight average molecular weight and the number average molecular weight are measured by gel permeation chromatography (GPC). Molecular weight measurement by GPC is performed by using a GPC HLC-8120GPC manufactured by Tosoh Corporation as a measurement device, using a column TSKgel SuperHM-M (15 cm) manufactured by Tosoh Corporation, and using a THF solvent. The weight average molecular weight and the number average molecular weight are determined from measurement results using a molecular weight calibration curve prepared based on a monodispersed polystyrene standard sample.

The amorphous polyester resin is obtained by a common production method. Specifically, for example, the amorphous polyester resin is obtained by a method in which the polymerization temperature is set to 180° C. or higher and 230° C. or lower, the pressure inside a reaction system is reduced as necessary, and reaction is performed while removing water or alcohols generated during condensation.

When a raw material monomer is not dissolved or compatible at the reaction temperature, a solvent having a high boiling point may be added as a dissolution aid to dissolve the monomer. In this case, a polycondensation reaction is performed while distilling off the dissolution aid. When there is a monomer having poor compatibility in a copolymerization reaction, the monomer having the poor compatibility may be firstly condensed with an acid or alcohol to be polycondensed with the monomer having poor compatibility, and then the obtained product is polycondensed with a main component.

Crystalline Polyester Resin

Examples of the crystalline polyester resin include a polycondensate of a polycarboxylic acid and a polyhydric alcohol. As the crystalline polyester resin, a commercially available product may be used, or a synthetic resin may be used.

Here, in order to easily form a crystal structure, the crystalline polyester resin may be a polycondensate using a linear aliphatic polymerizable monomer rather than a polymerizable monomer having an aromatic ring.

Examples of the polycarboxylic acid include aliphatic dicarboxylic acids (such as oxalic acid, succinic acid, glutaric acid, adipic acid, suberic acid, azelaic acid, sebacic acid, 1,9-nonandicarboxylic acid, 1,10-decandicarboxylic acid, 1,12-dodecanediocarboxylic acid, 1,14-tetradecanedicarboxylic acid, and 1,18-octadecanedicarboxylic acid), aromatic dicarboxylic acids (such as dibasic acids such as phthalic acid, isophthalic acid, terephthalic acid, and naphthalene-2,6-dicarboxylic acid), anhydrides thereof, and lower alkyl esters thereof (for example, having 1 to 5 carbon atoms).

As for the polycarboxylic acid, a trivalent or higher carboxylic acid having a crosslinked structure or a branched structure may be used in combination with the dicarboxylic acid. Examples of the trivalent carboxylic acid include aromatic carboxylic acids (such as 1,2,3-benzenetricarboxylic acid, 1,2,4-benzenetricarboxylic acid, and 1,2,4-naphthalenetricarboxylic acid), anhydrides thereof, and lower alkyl esters thereof (for example, having 1 to 5 carbon atoms).

As the polycarboxylic acid, a dicarboxylic acid having a sulfonic acid group or a dicarboxylic acid having an ethylenic double bond may be used in combination with the dicarboxylic acids.

The polycarboxylic acid may be used alone or in combination of two or more kinds thereof.

Examples of the polyhydric alcohol include aliphatic diols (such as linear aliphatic diols having 7 to 20 carbon atoms in the main chain part). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecandiol, 1,14-tetradecanediol, 1,18-octadecanediol, and 1,20-eicosanediol. Among these, the aliphatic diol is preferably 1,8-octanediol, 1,9-nonanediol, or 1,10-decanediol.

As for the polyhydric alcohol, a trihydric or higher alcohol having a crosslinked structure or a branched structure may be used in combination with the diol. Examples of the trihydric or higher alcohol include glycerin, trimethylolethane, trimethylolpropane, and pentaerythritol.

The polyhydric alcohol may be used alone or in combination of two or more kinds thereof.

Here, the polyhydric alcohol may have an aliphatic diol content of 80 mol % or more, and preferably has an aliphatic diol content of 90 mol % or more.

A melting temperature of the crystalline polyester resin may be 50° C. or higher and 100° C. or lower, and is preferably 55° C. or higher and 90° C. or lower, and more preferably 60° C. or higher and 85° C. or lower.

The melting temperature is obtained from a DSC curve obtained by the differential scanning calorimetry (DSC) according to the "melting peak temperature" described in the method for obtaining the melting temperature in "Method for measuring transition temperature of plastics" in JIS K7121: 1987.

A weight average molecular weight (Mw) of the crystalline polyester resin may be 6,000 or more and 35,000 or less.

The crystalline polyester resin may be obtained by, for example, a common production method like the case of the amorphous polyester resin.

A content of the binder resin may be 40 mass % or more and 95 mass % or less, and is preferably 50 mass % or more and 90 mass % or less, and more preferably 60 mass % or more and 85 mass % or less, relative to a total amount of the toner particles.

—Colorant—

Examples of the colorant include pigments such as carbon black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorant may be used alone or in combination of two or more kinds thereof.

As the colorant, a surface-treated colorant may be used as necessary, or the colorant may be used in combination with a dispersant. Plural kinds of colorants may be used in combination.

A content of the colorant may be 1 mass % or more and 30 mass % or less, and is preferably 3 mass % or more and 15 mass % or less, relative to the total amount of the toner particles.

—Releasing Agent—

Examples of the releasing agent include hydrocarbon wax, natural wax such as carnauba wax, rice wax, and candelilla wax, synthetic or mineral/petroleum wax such as montan wax, and ester wax such as fatty acid ester and montanic acid ester. The releasing agent is not limited thereto.

The melting temperature of the releasing agent may be 50° C. or higher and 110° C. or lower, and is preferably 60° C. or higher and 100° C. or lower.

The melting temperature is obtained from the "melting peak temperature" described in the method for obtaining the melting temperature in "Method for measuring transition temperature of plastics" in JIS K7121: 1987, from a DSC curve obtained by the differential scanning calorimetry (DSC).

A content of the releasing agent may be 1 mass % or more and 20 mass % or less, and is preferably 5 mass % or more and 15 mass % or less, relative to the total amount of the toner particles.

—Other Additives—

Examples of the other additives include common additives such as a magnetic material, ac charge-controlling agent, and an inorganic powder. These additives are contained in the toner particles as internal additives.

—Characteristics of Toner Particles—

The toner particles may have a single layer structure, or a so-called core-shell structure composed of a core portion (core particles) and a coating layer (shell layer) that covers the core portion.

The toner particles having a core-shell structure may be composed of, for example, a core portion including a binder resin and, if necessary, other additives such as a colorant and a releasing agent, and a coating layer including a binder resin.

A volume average particle diameter ($D50_V$) of the toner particles may be 2 μm or more and 10 μm or less, and is preferably 4 μm or more and 8 μm or less.

The volume average particle diameter ($D50_V$) of the toner particles is measured using Coulter Multisizer II (manufactured by Beckman Coulter, Inc.) with ISOTON-II (manufactured by Beckman Coulter, Inc.) as an electrolytic solution.

In the measurement, 0.5 mg or more and 50 mg or less of a measurement sample is added to 2 ml of a 5 mass % aqueous solution of a surfactant (for example, sodium alkylbenzene sulfonate) as a dispersant. The obtained mixture is added to 100 ml or more and 150 ml or less of the electrolytic solution.

The electrolytic solution in which the sample is suspended is dispersed for 1 minute with an ultrasonic disperser, and the particle size distribution of particles having a particle diameter in a range of 2 μm or more and 60 μm or less is measured by the Coulter Multisizer II using an aperture having an aperture diameter of 100 μm. The number of the particles sampled is 50,000. A divided particle size range (channel) is set and a volume-based particle size distribution is obtained. Then, a cumulative distribution is drawn from a small particle diameter side and a particle diameter corresponding to the cumulative percentage of 50% with respect to all the particles is the volume average particle diameter $D50_V$.

An average circularity of the toner particles may be 0.94 or more and 1.00 or less, and is preferably 0.95 or more and 0.98 or less.

The average circularity of the toner particles is obtained by (circle equivalent perimeter)/(perimeter) (i.e. (perimeter of a circle having the same projected area as a particle image)/(perimeter of the projected particle image)). Specifically, the average circularity is a value measured by the following method.

First, the toner particles to be measured are sucked and collected to form a flat flow, and flash light is emitted instantly to capture a particle image as a still image. The average circularity is obtained by a flow-type particle image analyzer (FPIA-3000 manufactured by Sysmex Corporation) that analyzes the particle image. The number of samples for obtaining the average circularity is 3,500.

In a case where the toner contains an external additive, the toner (developer) to be measured is dispersed in water containing a surfactant, and then an ultrasonic treatment is performed to obtain toner particles from which the external additive is removed.

—Method for Producing Toner Particles—

The toner particles may be manufactured by either a dry production method (such as a kneading and pulverization method) or a wet production method (such as an aggregation and coalescence method, a suspension and polymerization method, and a dissolution and suspension method). These production methods are not particularly limited, and common production methods are adopted. Among these, the toner particles may be obtained by the aggregation and coalescence method.

Specifically, for example, when the toner particles are produced by the aggregation and coalescence method, the toner particles are produced through a step of preparing a resin particle dispersion liquid in which resin particles to be a binder resin are dispersed (resin particle dispersion liquid preparation step), a step of aggregating the resin particles (and other particles if necessary) in the resin particle dispersion liquid (in a dispersion liquid after mixing with another particle dispersion liquid if necessary) to form aggregated particles (aggregated particle forming step), and a step of heating an aggregated particle dispersion liquid in which the aggregated particles are dispersed, and fusing and coalescing the aggregated particles to form the toner particles (fusion and coalescence step).

Details of each step will be described below.

In the following description, a method for obtaining toner particles containing a colorant and a releasing agent will be described, but the colorant and the releasing agent are used as needed. Of course, other additives other than the colorant and the releasing agent may be used.

—Resin Particle Dispersion Liquid Preparation Step—

In addition to the resin particle dispersion liquid in which the resin particles to be the binder resin are dispersed, for example, a colorant particle dispersion liquid in which colorant particles are dispersed and a releasing agent particle dispersion liquid in which releasing agent particles are dispersed are prepared.

The resin particle dispersion liquid is prepared by, for example, dispersing the resin particles in a dispersion medium with a surfactant.

Examples of the dispersion medium used in the resin particle dispersion liquid include an aqueous medium.

Examples of the aqueous medium include water such as distilled water and ion exchange water, and alcohols. The medium may be used alone or in combination of two or more kinds thereof.

Examples of the surfactant include anionic surfactants such as a sulfate-based surfactant, sulfonate-based surfactant, phosphate-based surfactant, and soap-based surfactant, cationic surfactants such as an amine salt-based surfactant and quaternary ammonium salt-based surfactant, and non-ionic surfactants such as a polyethylene glycol-based surfactant, alkylphenol ethylene oxide adduct-based surfactant, and polyhydric alcohol-based nonionic surfactant. Among these, the anionic surfactant and the cationic surfactant are particularly exemplified. The non-ionic surfactant may be used in combination with the anionic surfactant or the cationic surfactant.

The surfactant may be used alone or in combination of two or more kinds thereof.

Examples of a method for dispersing the resin particles in the dispersion medium in the resin particle dispersion liquid include general dispersion methods such as a rotary shear homogenizer, a ball mill having a medium, a sand mill, and a dyno mill. Depending on a kind of the resin particles, the resin particles may be dispersed in the dispersion medium by a phase inversion emulsification method. In the phase inversion emulsification method, a resin to be dispersed is dissolved in a hydrophobic organic solvent in which the resin is soluble, and a base is added to an organic continuous phase (O phase) to neutralize the resin, and then an aqueous medium (W phase) is added to perform phase inversion from W/O to O/W, and the resin is dispersed in the form of particles in the aqueous medium.

A volume average particle diameter of the resin particles dispersed in the resin particle dispersion liquid may be, for example, 0.01 μm or more and 1 μm or less, and is preferably 0.08 μm or more and 0.8 μm or less, and more preferably 0.1 μm or more and 0.6 μm or less.

The volume average particle diameter $D50_V$ of the resin particles is calculated by the volume-based particle size distribution obtained by measurement with a laser diffraction type particle size distribution measuring device (for example, LA-700 manufactured by HORIBA, Ltd.). A divided particle size range is set and the volume-based particle size distribution is obtained. Then, a cumulative distribution is drawn from a small particle diameter side and a particle diameter corresponding to the cumulative percentage of 50% with respect to all the particles is the volume average particle diameter $D50_V$. The volume average particle diameters of the particles in another dispersion liquid is measured in the same manner.

A content of the resin particles contained in the resin particle dispersion liquid may be 5 mass % or more and 50 mass % or less, and is preferably 10 mass % or more and 40 mass % or less.

Similar to the resin particle dispersion liquid, for example, the colorant particle dispersion liquid and the releasing agent particle dispersion liquid are also prepared. That is, the volume average particle diameter, dispersion medium, dispersion method, and content of the particles in the resin particle dispersion liquid are the same for the colorant particles dispersed in the colorant particle dispersion liquid and the releasing agent particles dispersed in the releasing agent particle dispersion liquid.

—Aggregated Particle Forming Step—

Next, the resin particle dispersion liquid, the colorant particle dispersion liquid, and the releasing agent particle dispersion liquid are mixed.

Then, the aggregated particles containing the resin particles, the colorant particles, and the releasing agent particles, each having a diameter close to the diameter of the target toner particles are formed by hetero-aggregating the resin particles, the colorant particles, and the releasing agent particles in the mixed dispersion liquid.

Specifically, for example, the aggregated particles are formed by adding an aggregating agent to the mixed dispersion liquid, adjusting the pH of the mixed dispersion liquid to acidic (for example, a pH of 2 or more and 5 or less), adding a dispersion stabilizer as needed, heating the mixed dispersion liquid to a temperature close to the glass transition temperature of the resin particles (specifically, for example, the temperature being equal to or higher than the glass transition temperature of the resin particles minus 30° C. and the temperature being equal to or lower than the glass transition temperature minus 10° C.), and aggregating the particles dispersed in the mixed dispersion liquid.

In the aggregated particle forming step, for example, while the mixed dispersion liquid is stirred with a rotary shear homogenizer, the aggregating agent may be added at room temperature (for example, 25° C.), the pH of the mixed dispersion liquid may be adjusted to acidic (for example, a pH of 2 or more and 5 or less), the dispersion stabilizer may be added if necessary, and then heating may be performed.

Examples of the aggregating agent include a surfactant having a polarity opposite to that of the surfactant contained in the mixed dispersion liquid, an inorganic metal salt, and a divalent or higher metal complex. In a case where the metal complex is used as the aggregating agent, an amount of the surfactant used is reduced and the chargeability is improved.

An additive that forms a complex or a similar bond with metal ions of the aggregating agent may be used together with the aggregating agent, if necessary. The additive may be a chelating agent.

Examples of the inorganic metal salt include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

As the chelating agent, a water-soluble chelating agent may be used. Examples of the chelating agent include oxycarboxylic acids such as tartaric acid, citric acid, and gluconic acid, and aminocarboxylic acids such as iminodiacetic acid (IDA), nitrilotriacetic acid (NTA), and ethylenediaminetetraacetic acid (EDTA).

An amount of the chelating agent added may be 0.01 parts by mass or more and 5.0 parts by mass or less, and is preferably 0.1 parts by mass or more and less than 3.0 parts by mass, relative to 100 parts by mass of the resin particles.

—Fusion and Coalescence Step—

Next, the aggregated particle dispersion liquid in which the aggregated particles are dispersed is heated to, for example, a temperature equal to or higher than the glass transition temperature of the resin particles (for example, a temperature being higher than the glass transition temperature of the resin particles by 10° C. to 30° C.), so that the aggregated particles are fused and coalesced to form the toner particles.

The toner particles are obtained through the above steps.

The toner particles may be produced through a step of obtaining an aggregated particle dispersion liquid in which aggregated particles are dispersed, then further mixing the aggregated particle dispersion liquid and the resin particle dispersion liquid in which the resin particles are dispersed, and performing aggregation so as to further adhere the resin particles to surfaces of the aggregated particles to form second aggregated particles, and a step of heating a second aggregated particle dispersion liquid in which the second aggregated particles are dispersed to fuse and coalesce the second aggregated particles, thereby forming the toner particles having a core-shell structure.

After the fusion and coalescence step is completed, the toner particles formed in the solution are subjected to a common washing step, solid-liquid separation step, and drying step to obtain dried toner particles. In the washing step, from the viewpoint of the chargeability, replacement washing with ion exchange water may be sufficiently performed. In the solid-liquid separation step, suction filtration, pressure filtration, or the like may be performed from the viewpoint of productivity. In the drying step, from the viewpoint of productivity, freeze-drying, air-flow drying, fluid-drying, vibration-type fluid-drying, or the like may be performed.

Then, the toner according to the exemplary embodiment is produced by, for example, adding an external additive to the obtained dried toner particles and mixing them. The mixing may be performed by, for example, a V blender, a Henschel mixer, a Loedige mixer, or the like. Further, if necessary, coarse particles in the toner may be removed by using a vibration sieving machine, a wind power sieving machine, or the like.

—External Additive—

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surface of the inorganic particles as the external additive may be subjected to a hydrophobic treatment. The hydrophobic treatment is performed by, for example, immersing the inorganic particles in a hydrophobic treatment agent. The hydrophobic treatment agent is not particularly limited, and examples thereof include a silane coupling agent, a silicone oil, a titanate coupling agent, and an aluminum coupling agent. The hydrophobic treatment agent may be used alone or in combination of two or more kinds thereof.

An amount of the hydrophobic treatment agent may be generally, for example, 1 part by mass or more and 10 parts by mass or less relative to 100 parts by mass of the inorganic particles.

Examples of the external additive also include resin particles (particles of resins such as polystyrene, polymethylmethacrylate, and melamine resin), and cleaning activators (for example, metal salts of higher fatty acids represented by zinc stearate, and particles of a fluoropolymer).

An amount of the external additive externally added may be, for example, 0.01 mass % or more and 5.0 mass % or less, and is preferably 0.01 mass % or more and 2.0 mass % or less, relative to the toner particles.

<Image Forming Apparatus and Image Forming Method>

An image forming apparatus according to the exemplary embodiment includes: an image carrier; a charging unit that charges a surface of the image carrier; an electrostatic charge image forming unit that forms an electrostatic charge image on the surface of the charged image carrier; a developing unit that accommodates an electrostatic charge image developer and develops, by the electrostatic charge image developer, the electrostatic charge image formed on the surface of the image carrier as a toner imager; a transfer unit that transfers the toner image formed on the surface of the image carrier to a surface of a recording medium; and a fixing unit that fixes the toner image transferred to the surface of the recording medium. As the electrostatic charge image developer, the electrostatic charge image developer according to the exemplary embodiment is used.

In the image forming apparatus according to the exemplary embodiment, an image forming method (an image forming method according to the exemplary embodiment) is performed, the image forming method including: a charging step of charging the surface of the image carrier; an electrostatic charge image forming step of forming the electrostatic charge image on the charged surface of the image carrier; a developing step of developing, by the electrostatic charge image developer, the electrostatic charge image formed on the surface of the image carrier as the toner image; a transfer step of transferring the toner image formed on the surface of the image carrier to the surface of the recording medium; and a fixing step of fixing the toner image transferred to the surface of the recording medium.

A common image forming apparatus such as a direct transfer type apparatus that directly transfers the toner image formed on the surface of the image carrier to the recording medium, an intermediate transfer type apparatus that primarily transfers the toner image formed on the surface of the image carrier to a surface of an intermediate transfer body, and secondarily transfers the toner image transferred to the surface of the intermediate transfer body to the surface of the recording medium, an apparatus including a cleaning unit that cleans the surface of the image carrier after the transfer of the toner image and before charging, and an apparatus including an erasing unit that erases the surface of the image carrier by irradiation with erasing light after the transfer of the toner image and before the charging, may be used as the image forming apparatus according to the exemplary embodiment.

In the case where the image forming apparatus according to the exemplary embodiment is an intermediate transfer type apparatus, the transfer unit includes, for example, an intermediate transfer body having a surface on which a toner image is transferred, a primary transfer unit that primarily transfers the toner image formed on the surface of the image carrier to the surface of the intermediate transfer body, and a secondary transfer unit that secondarily transfers the toner image transferred to the surface of the intermediate transfer body to the surface of the recording medium.

In the image forming apparatus according to the exemplary embodiment, for example, a part including the developing unit may have a cartridge structure (process cartridge) detachable from the image forming apparatus. As the process cartridge, for example, a process cartridge that accommodates the electrostatic charge image developer according to the exemplary embodiment and includes a developing unit may be used.

Hereinafter, an example of the image forming apparatus according to the exemplary embodiment will be described, but the image forming apparatus is not limited thereto. In the following description, the parts shown in the drawings will be described, and description of other parts will be omitted.

FIG. 1 is a schematic configuration diagram illustrating the image forming apparatus according to the exemplary embodiment.

The image forming apparatus illustrated in FIG. 1 includes first to fourth electrophotographic image forming units 10Y, 10M, 10C, and 10K (image forming units) that output images of respective colors of yellow (Y), magenta (M), cyan (C), and black (K) based on image data subjected to color separation. These image forming units (hereinafter may be simply referred to as "unit") 10Y, 10M, 10C, and 10K are arranged side by side at a preset distance from each other in a horizontal direction. These units 10Y, 10M, 10C, and 10K may be process cartridges that are detachable from the image forming apparatus.

Above the units 10Y, 10M, 10C, and 10K, an intermediate transfer belt (an example of the intermediate transfer body) 20 extends through respective units. The intermediate transfer belt 20 is provided by being wound around a drive roll 22 and a support roll 24, and travels in a direction from the first unit 10Y to the fourth unit 10K. A force is applied to the support roll 24 in a direction away from the drive roll 22 by a spring or the like (not shown), and tension is applied to the intermediate transfer belt 20 wound around the drive roll 22 and the support roll 24. An intermediate transfer body cleaning device 30 is provided on a side surface of an image carrier of the intermediate transfer belt 20 so as to face the drive roll 22.

Yellow, magenta, cyan, and black toners contained in toner cartridges 8Y, 8M, 8C, and 8K are supplied to developing devices 4Y, 4M, 4C, and 4K (an example of the developing unit) of the units 10Y, 10M, 10C, and 10K, respectively.

Since the first to fourth units 10Y, 10M, 10C, and 10K have the same configuration and operation, here, the first unit 10Y that is arranged on an upstream side in a travelling direction of the intermediate transfer belt and forms a yellow image will be described as a representative. 1M, 1C, and 1K in the second to fourth units 10M, 10C, and 10K are photoconductors corresponding to the photoconductor 1Y in the first unit 10Y; 2M, 2C and 2K are charging rolls corresponding to the charging roll 2Y; 3M, 3C, and 3K are laser beams corresponding to the laser beam 3Y; and 6M, 6C, and 6K are photoconductor cleaning devices corresponding to the photoconductor cleaning device 6Y.

The first unit 10Y includes the photoconductor 1Y (an example of the image carrier) that acts as an image carrier. Around the photoconductor 1Y, the following members are arranged in the following order: the charging roll (an example of the charging unit) 2Y that charges a surface of the photoconductor 1Y to a preset potential; an exposure device (an example of the electrostatic charge image forming unit) 3 that exposes the charged surface with the laser beam 3Y based on a color-separated image signal to form an electrostatic charge image; the developing device (an example of the developing unit) 4Y that supplies a charged toner to the electrostatic charge image to develop the electrostatic charge image; a primary transfer roll 5Y (an example of the primary transfer unit) that transfers the developed toner image onto the intermediate transfer belt 20; and the photoconductor cleaning device (an example of the cleaning unit) 6Y that removes the toner remaining on the surface of the photoconductor 1Y after the primary transfer.

The primary transfer roll 5Y is arranged on an inner side of the intermediate transfer belt 20 and is provided at a position facing the photoconductor 1Y. A bias power supply (not shown) that applies a primary transfer bias is connected to each of the primary transfer rolls 5Y, 5M, 5C, and 5K of respective units. Each bias power supply changes a value of the transfer bias applied to each primary transfer roll under the control of a controller (not shown).

Hereinafter, an operation of forming a yellow image in the first unit 10Y will be described.

First, prior to the operation, the surface of the photoconductor 1Y is charged to a potential of −600 V to −800 V by using the charging roll 2Y.

The photoconductor 1Y is formed by laminating a photoconductive layer on a conductive substrate (for example, having a volume resistivity of $1\times10^{-6}$ Ω·cm or less at 20° C.). The photoconductive layer usually has high resistance (resistance of general resin), but has characteristics that when irradiated with a laser beam, the specific resistance of the portion irradiated with the laser beam changes. Therefore, the charged surface of the photoconductor 1Y is irradiated with the laser beam 3Y from the exposure device 3 in accordance with yellow image data sent from the controller (not shown). As a result, an electrostatic charge image having a yellow image pattern is formed on the surface of the photoconductor 1Y.

The electrostatic charge image is an image formed on the surface of the photoconductor 1Y by charging, and is a so-called negative latent image formed by lowering the specific resistance of the portion of the photoconductive layer irradiated with the laser beam 3Y to allow charges on the surface of the photoconductor 1Y to flow and by, on the other hand, leaving charges of a portion not irradiated with the laser beam 3Y.

The electrostatic charge image formed on the photoconductor 1Y rotates to a preset developing position by travelling of the photoconductor 1Y. Then, at this developing position, the electrostatic charge image on the photoconductor 1Y is developed and visualized as a toner image by the developing device 4Y.

In the developing device 4Y, for example, an electrostatic charge image developer containing at least a yellow toner and a carrier is accommodated. The yellow toner is triboelectrically charged by being stirred inside the developing device 4Y, and has charges of the same polarity (negative polarity) as the charges on the photoconductor 1Y and is carried on a developer roller (an example of a developer carrier). Then, when the surface of the photoconductor 1Y passes through the developing device 4Y, the yellow toner electrostatically adheres to an erased latent image portion on the surface of the photoconductor 1Y, and the latent image is developed by the yellow toner. The photoreceptor 1Y on which the yellow toner image is formed continuously travels at a preset speed, and the toner image developed on the photoconductor 1Y is conveyed to a preset primary transfer position.

When the yellow toner image on the photoconductor 1Y is conveyed to the primary transfer position, a primary transfer bias is applied to the primary transfer roll 5Y, an electrostatic force from the photoconductor 1Y to the primary transfer roll 5Y acts on the toner image, and the toner image on the photoconductor 1Y is transferred to the intermediate transfer belt 20. The transfer bias applied at this time has a polarity (+) opposite to the polarity (−) of the toner, and is controlled to, for example, +10 μA by the controller (not shown) in the first unit 10Y.

On the other hand, the toner remaining on the photoconductor 1Y is removed and collected by the photoconductor cleaning device 6Y.

The primary transfer bias applied to each of the primary transfer rolls 5M, 5C, and 5K of the second unit 10M and the subsequent units is also controlled in the same manner as in the first unit.

In this way, the intermediate transfer belt 20 to which the yellow toner image is transferred by the first unit 10Y is sequentially conveyed through the second to fourth units 10M, 10C, and 10K, and toner images of the respective colors are superimposed and transferred in a multiple manner.

The intermediate transfer belt 20 onto which the toner images of four colors are transferred in a multiple manner through the first to fourth units arrives at a secondary transfer unit including the intermediate transfer belt 20, the support roll 24 in contact with an inner surface of the intermediate transfer belt, and a secondary transfer roll (an example of a secondary transfer unit) 26 arranged on an image carrying surface side of the intermediate transfer belt 20. On the other hand, a recording sheet (an example of the recording medium) P is fed through a supply mechanism to a gap where the secondary transfer roll 26 and the intermediate transfer belt 20 are in contact with each other at a preset timing, and a secondary transfer bias is applied to the support roll 24. The transfer bias applied at this time has the same polarity (−) as the polarity (−) of the toner. An electrostatic force from the intermediate transfer belt 20 to the recording sheet P acts on the toner image, and the toner image on the intermediate transfer belt 20 is transferred to the recording sheet P. The secondary transfer bias at this time is determined based on the resistance detected by a resistance detecting unit (not shown) that detects the resistance of the secondary transfer unit, and is controlled by voltage.

Thereafter, the recording sheet P is sent to a pressure-contacting portion (nip portion) of a pair of fixing rolls in a fixing device 28 (an example of the fixing unit), and the toner image is fixed onto the recording sheet P, thereby forming a fixed image.

Examples of the recording sheet P onto which the toner image is transferred include plain paper used in electrophotographic copiers, printers or the like. As the recording medium, in addition to the recording sheet P, an OHP sheet or the like may be used.

In order to further improve the smoothness of an image surface after fixing, the surface of the recording sheet P may also be smooth. For example, coating paper obtained by coating the surface of the plain paper with a resin or the like, art paper for printing, or the like may be used.

The recording sheet P, on which the fixing of the color image is completed is discharged toward a discharge unit, and a series of color image forming operations is completed.

<Process Cartridge>

The process cartridge according to the exemplary embodiment includes a developing unit that accommodates the electrostatic charge image developer according to the exemplary embodiment and develops, by the electrostatic charge image developer, the electrostatic charge image formed on the surface of the image carrier as the toner image, and is detachable from the image forming apparatus.

The process cartridge according to the exemplary embodiment is not limited to the above configuration and may be configured to include a developing unit and, if necessary, at least one selected from other units such as an image carrier, a charging unit, an electrostatic charge image forming unit, and a transfer unit.

Hereinafter, an example of the process cartridge according to the exemplary embodiment will be shown, but the process cartridge is not limited thereto. In the following description, the parts shown in the drawings will be described, and description of other parts will be omitted.

Figure 2:
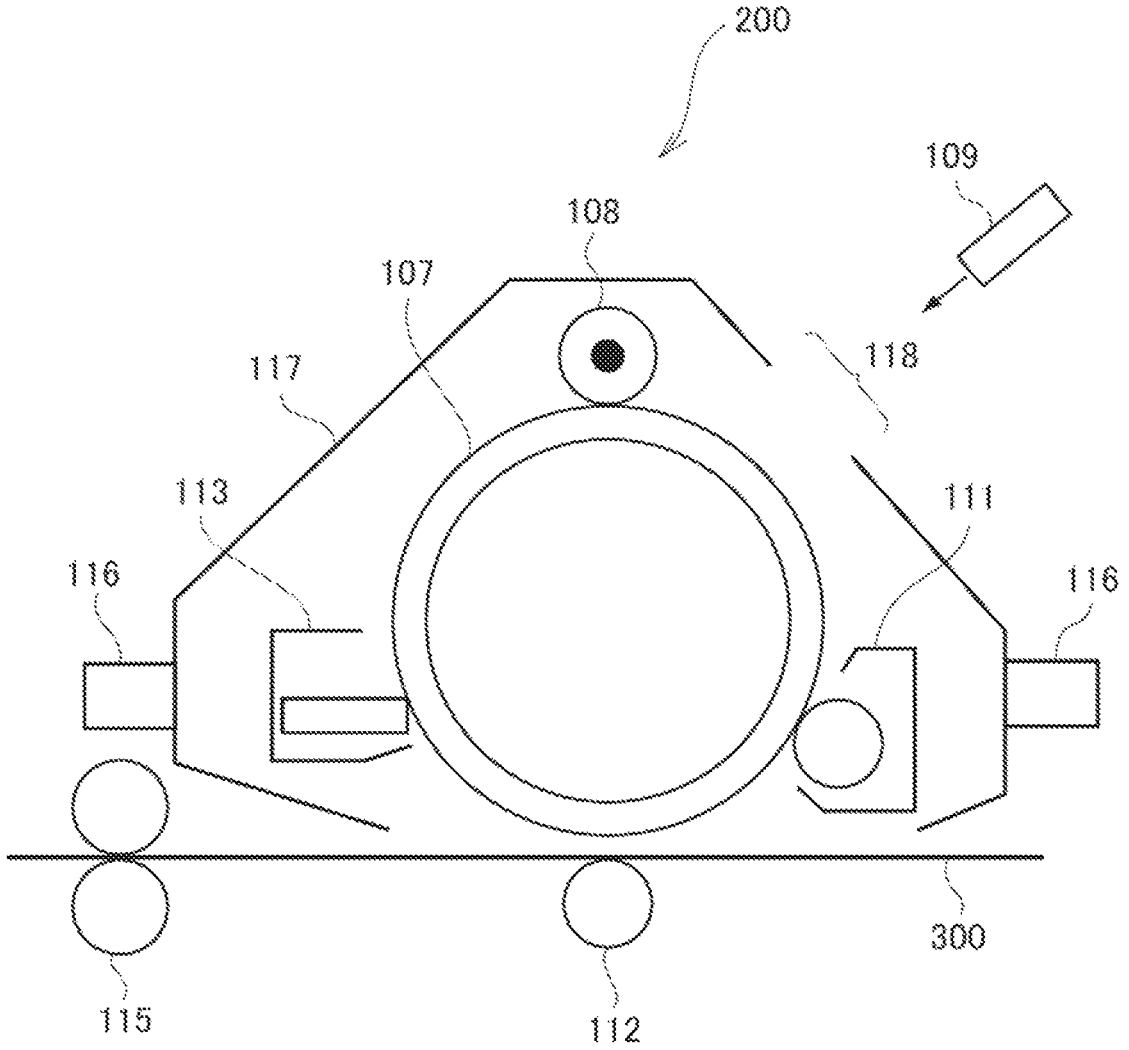
FIG. 2 is a schematic configuration diagram illustrating an example of a process cartridge detachable from the image forming apparatus according to the exemplary embodiment.

FIG. 2 is a schematic configuration diagram illustrating the process cartridge according to the exemplary embodiment.

A process cartridge 200 shown in FIG. 2 is formed as a cartridge by, for example, integrally combining and holding a photoconductor 107 (an example of the image carrier), a charging roll 108 (an example of the charging unit), an image developing device 111 (an example of the developing unit), and a photoconductor cleaning device 113 (an example of a cleaning unit), each provided around the photoconductor 107 by a housing 117 having a mounting rail 116 and an opening 118 for exposure.

In FIG. 2, the reference numeral 109 denotes an exposure device (an example of the electrostatic charge image forming unit), the reference numeral 112 denotes a transfer device (an example of the transfer unit), the reference numeral 115 denotes a fixing device (an example of the fixing unit), and the reference numeral 300 denotes recording sheet (an example of the recording medium).

EXAMPLES

Hereinafter, the exemplary embodiment of the invention will be described in detail with reference to Examples, but the exemplary embodiment of the invention is not limited to these Examples. In the following description, all "parts" and "%" are based on mass unless otherwise specified.

Example 1

<<Preparation of Ferrite Particles>>

1318 parts of $Fe_2O_3$, 587 parts of $Mn(OH)_2$, and 96 parts of $Mg(OH)_2$ are mixed and calcined at a temperature of 900° C. for 4 hours. The calcined product, 6.6 parts of polyvinyl alcohol, 0.5 parts of polycarboxylic acid as a dispersant, and zirconia beads having a media diameter of 1 mm are added to water, followed by pulverizing and mixing in a sand mill to obtain a dispersion liquid. A volume average particle diameter of particles in the dispersion liquid is 1.5 μm.

The dispersion liquid is used as a raw material and granulated and dried with a spray dryer to obtain granules having a volume average particle diameter of 37 μm. Next, under an oxygen-nitrogen mixed atmosphere having an oxygen partial pressure of 1%, firing is performed using an electric furnace at a temperature of 1450° C. for 4 hours, and then heating was performed in air at a temperature of 900° C. for 3 hours to obtain fired particles. The fired particles are crushed and classified to obtain ferrite particles (1) having a volume average particle diameter of 35 μm. An arithmetic average height Ra (JIS B0601: 2001) of a roughness curve of the ferrite particles is 0.6 μm.

<<Preparation of Coating Agent (1)>>

Resin (1): Perfluoropropylethyl methacrylate/methyl methacrylate copolymer (polymerization ratio by mass: 30:70, weight average molecular weight Mw=19,000): 12.1 parts Resin (2): Cyclohexyl methacrylate resin (weight average molecular weight: 350,000): 8.1 parts Carbon black (VXC72 manufactured by Cabot Corporation): 0.8 parts Inorganic particles (1): 9 parts (Commercially available hydrophilic silica particles (fumed silica particles, without surface treatment, volume average particle diameter: 40 nm))

Toluene: 250 parts

Isopropyl alcohol: 50 parts

The above materials and glass beads (diameter: 1 mm, the same amount as toluene) are added to a sand mill and stirred at a rotation speed of 190 rpm for 30 minutes, to obtain a coating agent (1).

<<Preparation of Carrier (1)>>

1,000 parts of the ferrite particles (1) and half of the coating agent (1) are added to a kneader and mixed at room temperature (25° C.) for 20 minutes. Then, the mixture is heated to 70° C., and dried under reduced pressure.

A dried product is cooled to room temperature (25° C.), the other half of the coating agent (1) is additionally added, and the mixture is mixed at room temperature (25° C.) for 20 minutes. Then, the mixture is heated to 70° C., and dried under reduced pressure for 20 minutes.

Next, a dried product is taken out from the kneader, and coarse powder is sieved with a mesh having a mesh size of 75 μm to obtain a carrier (1).

Examples 2 to 30 and Comparative Examples 1 to 3

As in Table 1, a carrier is obtained in the same manner as in Example 1 except that the kind and amount of the resin, the kind and amount of the inorganic particle, the mixing time after additional addition of the other half of the coating agent (1), and the drying time under reduced pressure are changed.

<Coating Resin Peeling Index A and Coating Resin Wear Index B>

The coating resin peeling index A and coating resin wear index B of the carrier in each example is measured in accordance with the methods described above.

<Image Density Fluctuation Evaluation>

In the image forming apparatus ("Iridesse Production Press" manufactured by Fuji Xerox Co., Ltd.), a developer in which the carrier and the toner are mixed at a mass ratio of 100:6 is added to the developing device at an M color position in each example.

With this image forming apparatus, M color images having an image density of 40% are printed on each of 100 sheets with A4 paper size, and then color images having an image density of 0.5% are printed on each of 50,000 sheets with A4 paper size.

Then, the density of the image having the image density of 40% on the 100th sheet (hereinafter referred to as the initial density) and the density of the image having the image density of 0.5% on the 50,000th sheet (hereinafter referred to as the density after the elapse of time) are measured with an image densitometer X-Rite 938 (manufactured by X-Rite Corporation) and evaluated according to the following criteria.

A: The difference between the initial density and the density after the elapse of time is less than Δ0.05, and there is no problem in image quality.

B: The difference between the initial density and the density after the elapse of time is Δ0.05 or more and less than Δ0.10, and the difference is not visually recognized.

C: The difference between the initial density and the density after the elapse of time is Δ0.10 or more and less than Δ0.30, and the difference is visually recognized.

D: The difference between the initial density and the density after the elapse of time is Δ0.30 or more.

TABLE 1

| | Coating Agent | | | | | | | | |
|---|---|---|---|---|---|---|---|---|---|
| | Resin | | Inorganic Particle | | | | | Mixing | Drying |
| | Kind | Mw × 10,000 | Kind | Amount Added (part) | Average Particle Diameter D [nm] | PFEM/MM (part) | CHM (part) | Time After Additional Addition [min] | Time under Reduced Pressure [min] |
| Example 1 | PFEM/MM, CHM | 15 | 1 | 9 | 40 | 12.1 | 8.1 | 20 | 20 |
| Example 2 | PFEM/MM, CHM | 15 | 1 | 9 | 40 | 12.1 | 8.1 | 30 | 20 |
| Example 3 | PFEM/MM, CHM | 15 | 1 | 9 | 40 | 12.1 | 8.1 | 10 | 20 |
| Example 4 | PFEM/MM, CHM | 15 | 1 | 9 | 40 | 12.1 | 8.1 | 20 | 8 |
| Example 5 | PFEM/MM, CHM | 15 | 2 | 13.5 | 4 | 18.4 | 12.3 | 20 | 20 |
| Example 6 | PFEM/MM, CHM | 15 | 3 | 12.6 | 7 | 17.2 | 11.4 | 20 | 20 |
| Example 7 | PFEM/MM, CHM | 15 | 6 | 5.1 | 88 | 6.7 | 4.4 | 20 | 20 |
| Example 8 | PFEM/MM, CHM | 15 | 7 | 4.5 | 93 | 5.8 | 3.9 | 20 | 20 |
| Example 9 | PFEM/MM, CHM | 15 | 2 | 9 | 4 | 12.1 | 8.1 | 20 | 20 |
| Example 10 | PFEM/MM, CHM | 15 | 3 | 9 | 7 | 12.1 | 8.1 | 20 | 20 |
| Example 11 | PFEM/MM, CHM | 15 | 6 | 9 | 88 | 12.1 | 8.1 | 20 | 20 |
| Example 12 | PFEM/MM, CHM | 15 | 7 | 9 | 93 | 12.1 | 8.1 | 20 | 20 |
| Example 13 | PFEM/MM, CHM | 15 | 1 | 4.5 | 40 | 5.8 | 3.9 | 20 | 20 |
| Example 14 | PFEM/MM, CHM | 15 | 1 | 5.1 | 40 | 6.7 | 4.4 | 20 | 20 |
| Example 15 | PFEM/MM, CHM | 15 | 1 | 12.6 | 40 | 17.2 | 11.4 | 20 | 20 |
| Example 16 | PFEM/MM, CHM | 15 | 1 | 13.5 | 40 | 18.4 | 12.3 | 20 | 20 |
| Example 17 | PFEM/MM, CHM | 15 | 4 | 5.04 | 12 | 13.3 | 8.9 | 20 | 20 |

| | Coating Resin Layer | | | | | | |
|---|---|---|---|---|---|---|---|
| | Content of Inorganic Particle [mass %] | Average Thickness T [μm] | D/T | Coating Resin Peeling Index A [ppm] | Coating Resin Wear Index B [ppm] | Arithmetic Average Height Ra [μm] | Image Density Fluctuation Evaluation |
| Example 1 | 30 | 1 | 0.04 | 1,400 | 800 | 0.52 | A |
| Example 2 | 30 | 1 | 0.04 | 810 | 800 | 0.38 | B |
| Example 3 | 30 | 1 | 0.04 | 1,980 | 1,500 | 0.7 | B |
| Example 4 | 30 | 1 | 0.04 | 1,460 | 2,970 | 0.5 | C |
| Example 5 | 30 | 1.5 | 0.003 | 850 | 600 | 0.16 | C |
| Example 6 | 30 | 1.4 | 0.005 | 1,000 | 1,000 | 0.32 | B |
| Example 7 | 30 | 0.6 | 0.147 | 1,700 | 2,200 | 0.85 | B |
| Example 8 | 30 | 0.5 | 0.186 | 1,800 | 2,700 | 0.96 | C |
| Example 9 | 30 | 1 | 0.004 | 950 | 300 | 0.13 | C |
| Example 10 | 30 | 1 | 0.007 | 1,120 | 600 | 0.3 | B |
| Example 11 | 30 | 1 | 0.088 | 1,650 | 2,000 | 0.77 | B |
| Example 12 | 30 | 1 | 0.093 | 1,750 | 2,500 | 0.89 | C |

TABLE 1-continued

| | | | | | | | |
|---|---|---|---|---|---|---|---|
| Example 13 | 30 | 0.5 | 0.08 | 1,200 | 500 | 0.3 | C |
| Example 14 | 30 | 0.6 | 0.067 | 1,300 | 600 | 0.42 | B |
| Example 15 | 30 | 1.4 | 0.029 | 1,800 | 1,400 | 0.58 | B |
| Example 16 | 30 | 1.5 | 0.027 | 1,900 | 1,800 | 0.71 | C |
| Example 17 | 18 | 1 | 0.012 | 880 | 2,900 | 0.12 | C |

| | Coating Agent | | | | | | | | |
|---|---|---|---|---|---|---|---|---|---|
| | | | Inorganic Particle | | | | | Mixing | Drying |
| | Resin | | | Amount | Average Particle | | | Time After Additional | Time under Reduced |
| | Kind | Mw × 10,000 | Kind | Added (part) | Diameter D [nm] | PFEM/MM (part) | CHM (part) | Addition [min] | Pressure [min] |
| Example 18 | PFEM/MM, CHM | 15 | 4 | 5.6 | 12 | 13.0 | 8.6 | 20 | 20 |
| Example 19 | PFEM/MM, CHM | 15 | 5 | 16.5 | 62 | 9.4 | 6.3 | 20 | 20 |
| Example 20 | PFEM/MM, CHM | 15 | 5 | 17.16 | 62 | 9.0 | 6.0 | 20 | 20 |
| Example 21 | PFEM/MM, CHM | 28 | 1 | 9 | 40 | 4.0 | 16.2 | 20 | 20 |
| Example 22 | CHM | 35 | 1 | 9 | 40 | 0.0 | 20.2 | 20 | 20 |
| Example 23 | PFEM/MM, CHM | 25 | 1 | 9 | 40 | 6.1 | 14.1 | 20 | 20 |
| Example 24 | PFEM/MM, CHM | 15 | 3 | 12.6 | 7 | 17.2 | 11.4 | 30 | 20 |
| Example 25 | PFEM/MM, CHM | 15 | 6 | 9 | 88 | 12.1 | 8.1 | 15 | 20 |
| Example 26 | PFEM/MM, CHM | 15 | 6 | 9 | 88 | 12.1 | 8.1 | 10 | 20 |
| Example 27 | PFEM/MM, CHM | 15 | 8 | 9.6 | 40 | 9.8 | 11.8 | 20 | 20 |
| Example 28 | PFEM/MM, CHM | 15 | 9 | 9.6 | 40 | 9.8 | 11.8 | 20 | 20 |
| Example 29 | PFEM/MM, CHM | 15 | 10 | 9.6 | 30 | 9.8 | 11.8 | 20 | 20 |
| Example 30 | PFEM/MM, CHM | 15 | 11 | 9.6 | 50 | 9.8 | 11.8 | 20 | 20 |
| Comparative Example 1 | PFEM/MM, CHM | 15 | 1 | 9 | 40 | 12.1 | 8.1 | 35 | 20 |
| Comparative Example 2 | PFEM/MM, CHM | 15 | 1 | 9 | 40 | 12.1 | 8.1 | 8 | 15 |
| Comparative Example 3 | PFEM/MM, CHM | 15 | 1 | 9 | 40 | 12.1 | 8.1 | 10 | 8 |

| | Coating Resin Layer | | | | | | |
|---|---|---|---|---|---|---|---|
| | Content of Inorganic Particle [mass %] | Average Thickness T [μm] | D/T | Coating Resin Peeling Index A [ppm] | Coating Resin Wear Index B [ppm] | Arithmetic Average Height Ra [μm] | Image Density Fluctuation Evaluation |
| Example 18 | 20 | 1 | 0.012 | 900 | 2,800 | 0.15 | B |
| Example 19 | 50 | 1 | 0.062 | 1,900 | 1,500 | 0.9 | B |
| Example 20 | 52 | 1 | 0.062 | 1,920 | 1,700 | 0.92 | C |
| Example 21 | 30 | 1 | 0.04 | 1,800 | 1,800 | 0.65 | B |
| Example 22 | 30 | 1 | 0.04 | 1,890 | 2,000 | 0.7 | C |
| Example 23 | 30 | 1 | 0.04 | 1,720 | 1,600 | 0.62 | B |
| Example 24 | 30 | 1.4 | 0.005 | 1,000 | 500 | 0.11 | B |
| Example 25 | 30 | 1 | 0.088 | 1,760 | 2,200 | 0.99 | B |
| Example 26 | 30 | 1 | 0.088 | 1,880 | 2,600 | 1.04 | C |
| Example 27 | 30 | 1 | 0.04 | 1,400 | 800 | 0.52 | B |
| Example 28 | 30 | 1 | 0.04 | 1,400 | 800 | 0.52 | B |
| Example 29 | 30 | 1 | 0.04 | 1,400 | 800 | 0.52 | B |
| Example 30 | 30 | 1 | 0.04 | 1,400 | 800 | 0.52 | B |
| Comparative Example 1 | 30 | 1 | 0.04 | 760 | 770 | 0.21 | D |
| Comparative Example 2 | 30 | 1 | 0.04 | 2,040 | 2,200 | 0.7 | D |
| Comparative Example 3 | 30 | 1 | 0.04 | 1,660 | 3,040 | 0.62 | D |

From the above results, it is found that in Examples, the image density fluctuation over time is prevented as compared with Comparative Examples.

Abbreviations in the table are as follows.

PFEM/MM: Copolymer of perfluoropropylethyl methacrylate and methyl methacrylate (polymerization ratio by mass being 30:70, weight average molecular weight Mw=19000)

CHM: Cyclohexyl methacrylate resin (weight average molecular weight: 350,000)

Mw: weight average molecular weight of mixed resin or single resin

<Preparation of Toner>

The toner used in the evaluation is a toner prepared as follows.

<<Preparation of Amorphous Polyester Resin Dispersion Liquid (A1)>>

Ethylene glycol: 37 parts

Neopentyl glycol: 65 parts 1,9-nonanediol: 32 parts

Terephthalic acid: 96 parts

The above materials are added to a flask and the temperature is raised to 200° C. over 1 hour, and after confirming that the inside of the reaction system is uniformly stirred, 1.2 parts of dibutyltin oxide is added. The temperature is raised to 240° C. over 6 hours while removing generated water by distillation, and stirring is continued at 240° C. for 4 hours to obtain an amorphous polyester resin (acid value: 9.4 mgKOH/g, weight average molecular weight: 13,000, and glass transition temperature: 62° C.). The amorphous polyester resin is transferred to an emulsification disperser (CAVITRON CD1010 manufactured by Eurotech Ltd.) at a rate of 100 g per minute while the amorphous polyester resin is in a molten state. Separately, diluted ammonia water having a concentration of 0.37% obtained by diluting reagent ammonia water with ion exchange water is put into a tank, and transferred to the emulsification disperser together with the amorphous polyester resin at a rate of 0.1 liter per minute while being heated to 120° C. in a heat exchanger. The emulsification disperser is operated under the conditions of a rotor rotation speed of 60 Hz and a pressure of 5 kg/cm$^2$ to obtain an amorphous polyester resin dispersion liquid (A1) having a volume average particle diameter of 160 nm and a solid content of 20%.

<<Preparation of Crystalline Polyester Resin Dispersion Liquid (C1)>>

Decanedioic acid: 81 parts

Hexanediol: 47 parts

The above materials are added to a flask and the temperature is raised to 160° C. over 1 hour, and after confirming that the inside of the reaction system is uniformly stirred, 0.03 parts of dibutyltin oxide is added. The temperature is raised to 200° C. over 6 hours while removing generated water by distillation, and stirring is continued at 200° C. for 4 hours. Next, the reaction liquid is cooled to perform solid-liquid separation, and a solid is dried under a reduced pressure at a temperature of 40° C. to obtain a crystalline polyester resin (C1) (melting point: 64° C., and weight average molecular weight: 15,000).

Crystalline polyester resin (C1): 50 parts

Anionic surfactant (NEOGEN RK manufactured by Daiichi Kogyo Seiyaku Co., Ltd.): 2 parts Ion exchange water: 200 parts The above materials are heated to 120° C., sufficiently dispersed by a homogenizer (ULTRA-TURRAX T50 manufactured by IKA Co., Ltd.), and then subjected to a dispersion treatment with a pressure discharge type homogenizer. When the volume average particle diameter reaches 180 nm, the mixture is recovered to obtain a crystalline polyester resin dispersion liquid (C1) having a solid content of 20%.

<<Preparation of Releasing Agent Particle Dispersion Liquid (W1)>>

Paraffin wax (HNP-9 manufactured by Nippon Seiro Co., Ltd.): 100 parts

Anionic surfactant (NEOGEN RK manufactured by Daiichi Kogyo Seiyaku Co., Ltd.): 1 part Ion exchange water: 350 parts The above materials are mixed and heated to 100° C., dispersed using the homogenizer (ULTRA-TURRAX T50 manufactured by IKA Co., Ltd.), and then subjected to a dispersion treatment with a pressure discharge type Gaulin homogenizer to obtain a releasing agent particle dispersion liquid in which releasing agent particles having a volume average particle diameter of 200 nm are dispersed. Ion-exchange water is added to the releasing agent particle dispersion liquid to prepare a releasing agent particle dispersion liquid (W1) having a solid content of 20%.

<<Preparation of Colorant Particle Dispersion Liquid (C1)>>

Cyan pigment (Pigment Blue 15:3, manufactured by Dainichiseika Color & Chemicals Mfg. Co., Ltd.): 50 parts Anionic surfactant (NEOGEN RK manufactured by Daiichi Kogyo Seiyaku Co., Ltd.): 5 parts Ion exchange water: 195 parts The above materials are mixed and subjected to a dispersion treatment for 60 minutes using a high-pressure impact type disperser (ULTIMAIZER HJP30006 manufactured by Sugino Machine Ltd.) to obtain a colorant particle dispersion liquid (C1) having a solid content of 20%.

<Preparation of Inorganic Particles Internally Added to Coating Resin Layer of Carrier>

The inorganic particles internally added to the coating resin layer of the carrier are as follows.

<<Inorganic Particles (1)>>

Commercially available hydrophilic silica particles (fumed silica particles, without surface treatment, volume average particle diameter: 40 nm) are prepared as inorganic particles (1).

<<Inorganic Particles (2)>>

890 parts of methanol and 210 parts of 9.8% ammonia water are added to a 1.5 L glass reaction vessel equipped with a stirrer, a dropping nozzle, and a thermometer and mixed to obtain an alkaline catalyst solution. After the alkaline catalyst solution is adjusted to 45° C., 550 parts of tetramethoxysilane and 140 parts of 7.6% ammonia water are simultaneously added dropwise over 450 minutes while stirring, thereby obtaining a silica particle dispersion liquid (A). The silica particles in the silica particle dispersion liquid (A) have a volume average particle diameter of 4 nm and a volume particle size distribution index (square root $(D84_V/D16_V)^{1/2}$ of a ratio of a particle diameter $D84_V$ at 84% accumulation to a particle diameter $D16_V$ at 16% accumulation from the small diameter side in the particle size distribution by volume) being 1.2.

300 parts of the silica particle dispersion liquid (A) is added to an autoclave equipped with a stirrer, and the stirrer is rotated at a rotation speed of 100 rpm. While the stirrer is continuously rotated, liquefied carbon dioxide is injected into the autoclave from a carbon dioxide cylinder via a pump, a pressure inside the autoclave is raised by the pump while the temperature is raised by a heater, and the inside of the autoclave is changed to a supercritical state of 150° C. and 15 MPa. A pressure valve is operated to circulate supercritical carbon dioxide while keeping the inside of the autoclave at 15 MPa, and methanol and water are removed from the silica particle dispersion liquid (A). When an amount of carbon dioxide supplied into the autoclave became 900 parts, supply of carbon dioxide is stopped and a powder of silica particles is obtained.

In a state where the inside of the autoclave is maintained at 150° C. and 15 MPa by the heater and the pump to maintain the supercritical state of carbon dioxide, 50 parts of hexamethyldisilazane relative to 100 parts of silica particles is injected into the autoclave by an entrainer pump while the stirrer of the autoclave is continuously rotated, the temperature inside the autoclave is raised to 180° C., and a reaction is performed for 20 minutes. Next, the supercritical carbon dioxide is circulated again in the autoclave, and excess hexamethyldisilazane is removed. Next, stirring is stopped, the pressure valve is opened to release the pressure in the autoclave to atmospheric pressure, and the temperature is lowered to room temperature (25° C.). In this way, silica particles surface-treated with the hexamethyldisilazane are obtained. The silica particles have a volume average particle diameter of 4 nm. The obtained silica particles are inorganic particles (2).

<<Inorganic Particles (3)>>

In the same manner as the preparation of the inorganic particles (2) except that the amounts of the tetramethoxysilane and the 7.6% ammonia water dropped for the preparation of the silica particle dispersion liquid (A) are increased to change the volume average particle diameter of the silica particles in the silica particle dispersion liquid to 7 nm, and silica particles surface-treated with the hexamethyldisilazane are obtained. The silica particles have a volume average particle diameter of 7 nm. The obtained silica particles are inorganic particles (3).

<<Inorganic Particles (4)>>

Commercially available hydrophobic silica particles (fumed silica particles surface-treated with hexamethyldisilazane, volume average particle diameter: 12 nm) are prepared as inorganic particle (4).

<<Inorganic Particles (5)>>

Commercially available hydrophilic silica particles (fumed silica particles, without surface treatment, volume average particle diameter: 62 nm) are prepared as inorganic particles (5).

<<Inorganic Particles (6)>>

Commercially available hydrophobic silica particles (fumed silica particles surface-treated with hexamethyldisilazane, volume average particle diameter: 88 nm) are prepared as inorganic particle (6).

<<Inorganic Particles (7)>>

Commercially available hydrophobic silica particles (fumed silica particles surface-treated with hexamethyldisilazane, volume average particle diameter: 93 nm) are prepared as inorganic particle (7).

<<Inorganic Particles (8)>>

Commercially available calcium carbonate particles (volume average particle diameter: 40 nm) are prepared as inorganic particles (8).

<<Inorganic Particles (9)>>

Commercially available barium carbonate particles (volume average particle diameter: 40 nm) are prepared as inorganic particles (9).

<<Inorganic Particles (10)>>

Barium sulfate particles (BARIFINE BF-20, volume average particle diameter: 30 nm) are prepared as inorganic particles (10).

<<Inorganic Particles (11)>>

Barium sulfate particles (BARIFINE BF-21, volume average particle diameter: 50 nm) are prepared as inorganic particles (11).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An electrostatic charge image developing carrier comprising:

a magnetic particle; and a coating resin layer that covers the magnetic particle, wherein an amount of the coating resin layer that is peeled off from the magnetic particle when the carrier dispersed in water is irradiated with ultrasonic waves, relative to a coating amount of the coating resin layer before ultrasonic irradiation, is 800 mass ppm or more and 2,000 mass ppm or less, and a difference between an initial coating amount of the coating resin layer of a carrier having no travel history and a coating amount of the coating resin layer of a carrier having a travel history and being taken out from an electrostatic charge image developer, relative to the initial coating amount of the coating resin layer, is 0 mass ppm or more and 3,000 mass ppm or less.

2. The electrostatic charge image developing carrier according to claim 1, wherein the coating resin layer contains an inorganic particle.

3. The electrostatic charge image developing carrier according to claim 2, wherein an average particle diameter of the inorganic particle is smaller than an average thickness of the coating resin layer.

4. The electrostatic charge image developing carrier according to claim 3, wherein a ratio of the average particle diameter of the inorganic particle to the average thickness of the coating resin layer (average particle diameter of inorganic particle/average thickness of coating resin layer) is 0.005 or more and 0.1500 or less.

5. The electrostatic charge image developing carrier according to claim 4, wherein the average particle diameter of the inorganic particle is 5 nm or more and 90 nm or less.

6. The electrostatic charge image developing carrier according to claim 3, wherein the average particle diameter of the inorganic particle is 5 nm or more and 90 nm or less.

7. The electrostatic charge image developing carrier according to claim 2, wherein a ratio of an average particle diameter of the inorganic particle to an average thickness of the coating resin layer (average particle diameter of inorganic particle/average thickness of coating resin layer) is 0.005 or more and 0.1500 or less.

8. The electrostatic charge image developing carrier according to claim 7, wherein the average particle diameter of the inorganic particle is 5 nm or more and 90 nm or less.

9. The electrostatic charge image developing carrier according to claim 2, wherein an average particle diameter of the inorganic particle is 5 nm or more and 90 nm or less.

10. The electrostatic charge image developing carrier according to claim 2, wherein an average thickness of the coating resin layer is 0.6 μm or more and 1.4 μm or less.

11. The electrostatic charge image developing carrier according to claim 2, wherein the inorganic particle has the same charge polarity as an external additive for a toner.

12. The electrostatic charge image developing carrier according to claim 2, wherein the inorganic particle is an inorganic oxide particle.

13. The electrostatic charge image developing carrier according to claim 2, wherein a content of the inorganic particle is 20 mass % or more and 50 mass % or less relative to a total mass of the coating resin layer.

14. The electrostatic charge image developing carrier according to claim 1, wherein a weight average molecular weight of a resin contained in the coating resin layer is less than 300,000.

15. The electrostatic charge image developing carrier according to claim 14, wherein the weight average molecular weight of the resin contained in the coating resin layer is less than 250,000.

16. The electrostatic charge image developing carrier according to claim 1, wherein an arithmetic average height Ra of a roughness curve of the carrier is 0.1 μm or more and 1.0 μm or less.

17. An electrostatic charge image developer comprising:

an electrostatic charge image developing toner; and the electrostatic charge image developing carrier according to claim 1.

18. A process cartridge detachable from an image forming apparatus, the process cartridge comprising:

a developing unit that accommodates the electrostatic charge image developer according to claim 17 and develops an electrostatic charge image formed on a surface of an image carrier as a toner image by the electrostatic charge image developer.

19. An image forming apparatus comprising:

an image carrier;

a charging unit that charges a surface of the image carrier;

an electrostatic charge image forming unit that forms an electrostatic charge image on the charged surface of the image carrier;

a developing unit that accommodates the electrostatic charge image developer according to claim 17 and develops the electrostatic charge image formed on the surface of the image carrier as a toner image by the electrostatic charge image developer;

a transfer unit that transfers the toner image formed on the surface of the image carrier to a surface of a recording medium; and a fixing unit that fixes the toner image transferred to the surface of the recording medium.

20. An image forming method comprising:

charging a surface of an image carrier;

forming an electrostatic charge image on the charged surface of the image carrier;

developing the electrostatic charge image formed on the surface of the image carrier as a toner image using the electrostatic charge image developer according to claim 17;

transferring the toner image formed on the surface of the image carrier to a surface of a recording medium; and fixing the toner image transferred to the surface of the recording medium.

* * * * *